US006677091B2

(12) United States Patent
Niimi

(10) Patent No.: US 6,677,091 B2
(45) Date of Patent: Jan. 13, 2004

(54) ELECTROPHOTOGRAPHIC PHOTORECEPTOR AND ELECTROPHOTOGRAPHIC APPARATUS

(75) Inventor: Tatsuya Niimi, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 90 days.

(21) Appl. No.: 10/102,867

(22) Filed: Mar. 22, 2002

(65) Prior Publication Data

US 2003/0104295 A1 Jun. 5, 2003

(30) Foreign Application Priority Data

Mar. 22, 2001 (JP) ..... 2001-083469
Mar. 26, 2001 (JP) ..... 2001-086532
Feb. 5, 2002 (JP) ..... 2002-028623

(51) Int. Cl.[7] ..... G03G 15/04
(52) U.S. Cl. ..... 430/66
(58) Field of Search ..... 430/66

(56) References Cited

U.S. PATENT DOCUMENTS 5,028,502 A 7/1991 Yuh et al.
5,100,453 A 3/1992 Richards
5,789,128 A 8/1998 Adachi et al.
5,834,145 A 11/1998 Yoshinaga et al.
5,846,680 A 12/1998 Adachi et al.
5,910,561 A 6/1999 Adachi et al.
5,928,828 A 7/1999 Suzuki
5,942,363 A 8/1999 Tanaka et al.
5,999,773 A 12/1999 Yasutomi et al.
6,026,262 A 2/2000 Kinoshita et al.
6,030,736 A 2/2000 Ikegami et al.
6,069,224 A 5/2000 Adachi et al.
6,136,483 A 10/2000 Suzuki et al.
6,191,249 B1 2/2001 Tanaka et al.
6,249,304 B1 6/2001 Sawayama et al.
6,322,940 B1 11/2001 Nishigaki et al.
6,326,112 B1 12/2001 Tamura et al.
6,366,751 B1 4/2002 Shakuto et al.
6,406,826 B1 6/2002 Suzuki et al. ..... 430/111.35
6,432,596 B2 8/2002 Ikuno et al.
6,444,387 B2 9/2002 Ri et al.
6,468,706 B2 10/2002 Matsuda et al. ..... 430/108.6
6,492,079 B2 12/2002 Shimada et al.

FOREIGN PATENT DOCUMENTS

JP 08-234471 9/1996
JP 08-314174 11/1996

*Primary Examiner*—Mark A. Chapman
(74) *Attorney, Agent, or Firm*—Oblon, Spivak, McClelland, Maier & Neustadt, P.C.

(57) ABSTRACT

A photoreceptor that can be repeatedly used to produce high-quality images steadily is described, as well as an electrophotographic apparatus that can be used to producing high-quality images even after repeated use. The electrophotographic photoreceptor has a protective layer thereon, in which the grain size distribution of the fillers continuously or gradually increases from the photosensitive layer side to the surface side. Meanwhile, the electrophotographic photoreceptor is used in the electrophotographic apparatus.

49 Claims, 5 Drawing Sheets

ELECTROPHOTOGRAPHIC PHOTORECEPTOR AND ELECTROPHOTOGRAPHIC APPARATUS

CROSS-REFERENCE TO RELATED APPLICATION

This application claims the priority benefit of Japanese application serial nos. 2001-083469, filed on Mar. 22, 2001, 2001-086532, filed on Mar. 26, 2001 and 2002-028623, filed on Feb. 5, 2002.

BACKGROUND OF THE INVENTION

1. Field of Invention

The present invention relates to a photoreceptor that has a surface layer with a specific structure and thereby has high sensitivity, high resolution and high durability. Moreover, the present invention relates to an electrophotographic method, an electrophotographic apparatus and a process cartridge used in electrophotography that use the photoreceptor of this invention.

2. Description of Related Art

In the prior art, the electrophotographic methods, which include the Carlson method and various modifications thereof, are widely used in copying machines and printers. In the photoreceptor used in such electrophotographic methods, organic photosensitive materials have been used recently since they are cheap, pollution-free, and suitable for mass production. The types of organic-type electrophotographic photoreceptor include the photoconductive resin type represented by polyvinylcarbazole, the charge-transfer complex type represented by 2,4,7-trinitrofluoreone (PVK-TNF), the pigment dispersion type represent by phthalocyanine binder, and the function separated type using a charge-generating material and a charge-transferring material in combination. Among them, the function separated type gets much attention.

The forming mechanism of an electrostatic latent mage on a photoreceptor of function separated type is explained below. The photoreceptor is firstly charged and then irradiated with light, which passes through a transparent charge-conducting layer to be absorbed by a charge-generating material in a charge-generating layer. Charges will be generated from the charge-generating material due to the light absorption and then injected into the charge-transferring layer and driven by the electric field established by charging to move in the charge-transferring layer. The charges induced by the light absorption will neutralize some charges on the surface of the photoreceptor to form an electrostatic latent mage thereon. A charge-transferring material mainly absorbing UV light and a charge-generating material mainly absorbing visible light can be used together in a photoreceptor of function separation type, and such a combination is particularly advantageous.

Recently, the miniaturization of the photoreceptor is desired and the photoreceptor and the machine using the same are both required having a high durability (long lifetime). Accordingly, the organic photosensitive bodies have been developed energetically and are actually progressive in the issue of high sensitivity and high electrostatic durability of the photoreceptor. However, the mechanical durability of the photoreceptor, especially the wear resistance of the photoreceptor, is always considered to be insufficient. In view of this, the photosensitive bodies that have surfaces having improved mechanical durability are proposed, wherein those using binder resin on their surfaces are frequently investigated. However, those methods are always not satisfactory.

In another point of view, the durability problem can be solved by forming a protective layer on the outmost surface of the photoreceptor. The effects of using a protective layer as the surface layer of a photoreceptor, as started from the cases of the inorganic photosensitive bodies, are discussed in Japan Patent Publication No. Hei 2-3171, Hei 2-7058 and Hei 3-43618. Where a protective layer is disposed on the surface of an inorganic photoreceptor, the protective layer preferably comprises fillers having low specific resistance. Thus when the surface of the photoreceptor is being charged, the bulk of the protective layer and the photoreceptor/protective layer interface can also be charged easily. Certainly, another merit lies on that the latent image is not formed on the surface of the photoreceptor but in the protective layer (including the interface with the photoreceptor), and the shape (defects or the like) of the surface of the photoreceptor therefore has little affect on the latent image. However, if the protective layer serving as a surface layer is intended to have the aforementioned functions, a large amount of electrically conductive metal oxide fillers have to be added into it. In this situation, since the bulk or the surface of the surface layer has a low resistance, the so-called "image blur" effect will occur as a drawback after repeated use even if the transparency of the surface layer is maintained. Japan Patent Publication No. Hei 2-7057 and JP-2675035 disclose a method for solving this problem, in which the concentration of the electrically conductive metal oxide in the surface layer varies along the vertical direction from the surface of the coating. By using this method, the drawbacks such as the image blur and the flowing defects can be prevented.

Moreover, as another method for solving the image blur problem with treatments during the process, an apparatus is used mounted with a drum heater for heating the photoreceptor. Though the image blur can be prevented from occurring by heating the photoreceptor, the incorporation of the drum heater will inevitably increase the size of the photoreceptor. Therefore, the method cannot be applied to miniaturized photosensitive bodies currently used in the mainstream accompanied with the miniaturization of electrophotographic apparatuses. In addition, high durability of a miniaturized photoreceptor is also hard to achieve by using this method. Moreover, the incorporation of the drum heater causes many problems in real use, such as the increased size of the photographic apparatus, the remarkably increased electricity consumption, and the increased time needed to setup the apparatus.

Because the transparency of the protective layer has to be maintained, it is important to assure that each component of the protective layer is transparent to the light used for writing the image. Particularly, the filler contained in the protective layer has a refractive index different from that of the binder resin used in the protective layer in most cases, so the protective layer tends to be opaque. To improve the problem for maintaining the transparency of the film, the filler can be made to have a size as small as possible. When the size of the filler is smaller than the wavelength of the light for writing the image, light scattering will not occur substantially and the protective layer becomes transparent. For example, a method is disclosed in which the mean size of the metal grains or the metal oxide grains contained in the filler is smaller than 0.3 $\mu$m (Japanese Patent Application Laid Open No. Sho 57-30846), so that the protective layer becomes substantially transparent and the residual voltage accumulation can also be inhibited. Though its effect on maintaining the transparency of the protective layer is recognized, the use of such fillers has little effect on increasing the wear resistance of the protective layer. In view of this, instead of increasing the wear resistance of the filler, increasing the wear resistance of the binder is a more effective way for improving the wear resistance of the protective layer. Specifically, when an inorganic protective layer with durable electrostatic properties and high wear resistance fabricated by using this method is incorporated with an inorganic photoreceptor represented by the saline photoconductive layer, a photoreceptor having a quite long lifetime can be obtained. Moreover, the transparency of the protective layer can also be obtained by using fillers with a mean grain size larger than 0.3 $\mu$m if only the dispersibility of the grain is high enough. On the other hand, if the fillers condense to a certain degree, the transparency of the protective layer will still be reduced even if the mean grain size is smaller than 0.3 $\mu$m.

On another aspect, the photoreceptor has shifted toward the pollution-free organic photoreceptor and one can even say that all of the photosensitive bodies used in the world are of organic type. With the target of fabricating highly durable organic photosensitive bodies, the development of the protective layer capable of matching with the organic photosensitive layers is a major issue.

In view of this, for example, a method that uses a mixture of at least two kinds of fillers having different grain sizes or different specific weights on the outmost surface of the photoreceptor is described in Japanese Patent Application Laid Open No. Hei 8-234471 and Hei 8-314174. In this case, the aforementioned trade-off relationship is relaxed as compared with the cases where only one kind of filler is used, and the design margin thus can be increased. However, since the two kinds of fillers having different grain size must be densely packed to a certain degree in the protective layer to meet the requirement of wear resistance, the transparency of the coating film is reduced and the scattering of the writing light is increased with a degree dependent on the species of the filler. Therefore, such methods are always not satisfactory. Moreover, if the filler with small grain sizes (large surface area) is close to the surface of the protective layer, various materials like reactive gases will be easily adsorbed on their surfaces to easily cause degradation of the photoreceptor (e.g., image blur). Therefore, when two kinds of fillers having different mean grain sizes are used together, the filler with small grain sizes has to be excluded from the surface of the photoreceptor. This is just the strategy adopted by this invention that use a protective layer with a gradient grain size distribution to solve the aforementioned problem.

Moreover, the inorganic photoreceptor usually adopts a positively charging method regardless the existence of the protective layer. On the other hand, the charge-transferring materials developed to be used in the organic photoreceptor are divided into the hole conducting type and the electron conducting type, wherein those of hole conducting type has been developed to a practical level in real use. Therefore, in order to develop the effects of the organic photoconductor (OPC) to the maximal limits, the laminated photosensitive layers of function separated type are all of negatively charged type. On the other hand, the development of monolayer type or reverse-layer type photosensitive layers is not in the mainstream.

One of the reasons that the protective layer techniques developed for the inorganic photoreceptor cannot be directly applied to the organic photoreceptor is that the charging types of the two are different (positive or negative). Since the absolute values of the charging voltages of the inorganic photosensitive body and the organic photosensitive body are almost the same, the positively charged one generally has a higher charging efficiency in consideration of the discharging efficiency of the discharger. In addition, by comparing the positively charged one and the negatively charged one, it is known that the amounts of the reactive gases or the like generated in the negatively charged one is much larger. It is also understood that at least the reduction of the surface resistance of the photoreceptor will causes the image blur problem, while the main cause of the reduction of the surface resistance is the adsorption of low-resistance materials on the surface of the photoreceptor that are generated due to the reactive gases.

In order to improve the problem, a contact-type charging method is proposed, in which a positive image data is disclosed certainly with a low ozone concentration near the charging member. However, according to the measuring results of the inventor, it is understood that the amount of the adsorbed low-resistance materials in the contact-type charging method is the same as that in the non-contact-type charging method. The reason is considered to be that the gap between the charging member and photoreceptor is so narrow that the gas flow cannot pass through it when the voltage applied to the charging member is being lowered for discharging. Another reason may be that the charging member is in contact with the photoreceptor so that the low-resistance materials is directly forced onto the surface of the photoreceptor.

So far, the method capable of simultaneously solving the aforementioned problems has not been found. When an outmost surface layer containing fillers, such as a protective layer, is formed on the photoreceptor to attain high durability, the image blur effect and the residual voltage rise effect both become more severe, and there are still many problems to be solved for attaining high image quality in practice. Moreover, if a drum heater is required to be used for reducing the aforementioned adverse effects, a high durability cannot be achieved for the miniaturized photosensitive bodies that need durability most, and the miniaturization of the apparatus and the reduction of the electricity are hindered in practice.

Moreover, the organic photoreceptor is superior than the inorganic photoreceptor in photosensitivity, spectral sensitivity range, pollution reduction and electrostatic durability, but the mechanical durability thereof has to be improved as soon as possible to develop its advantages. The development of the mechanical durability of the organic photoreceptor is most desired for designing a highly durably machine/process.

Full-color image forming apparatuses using electrophotographic methods can be divided into two types. The first type uses the so-called single method or single drum method. An electrophotographic photoreceptor and developing members of 4 colors are disposed in the apparatus. In this method, the toner images of 4 colors (cyan, magenta, yellow and black) are formed on the photoreceptor or a transfer member, which is a paper for output or an intermediate transfer body that transfers the image onto a paper once an image is transferred onto it. In this method, the charging member, the exposing member, the transferring member, the cleaning member and the fixing member disposed around the photoreceptor can be integrated. Consequently, the apparatus is smaller and has a lower cost as compared with the tandem method that will be described next.

The second type uses the so-called tandem method or tandem drum method. In this method, a plurality of electrophotographic photoreceptor is disposed in the apparatus. Generally, each drum is in combination with a charging member, an exposing member, a developing member and a cleaning member to form an electrophotographic element, which is duplicated into a plurality corresponding to the number of the drums (usually 4). In this method, the toner image of each color is formed on an individual electrophotographic element and then transferred onto a transfer body in turn to form a full-color image. By using this method, the first merit is that the high-speed image formation is possible since the toner image of each color can be formed simultaneously. Therefore, the processing time required for forming the image in this method is one fourth of that required in the single method, which means the speed of the image printing is higher by four times. The second merit is that all of the members used in the electrophotographic elements, including the photoreceptor, substantially have higher durability since one photoreceptor is used 4 times to form a full-color image in the single method but is used only once in the tandem method.

However, this method also has the demerits such as the increasing size of the whole apparatus and the high cost. In order to solve the problems, the photoreceptor and all the members around it have to be miniaturized correspondingly to reduce the size of each electrophotographic element, so as to have the benefits of reducing the size of the whole apparatus and reducing the cost of the used materials. Consequently, the cost of the whole apparatus can also be lowered. However, in company with compactness and miniaturization of the apparatus, the durability of all members of the electrophotographic element including the photoreceptor needs to be improved and there are still new issues to be studied.

Moreover, since the images on different image forming elements must be formed simultaneously in the tandem-type image forming method, it is an important issue to make all of the image forming elements have substantially the same properties at the beginning as well as after a long period of time (repeated use). The most critical factor about this issue is the electrostatic property of the photoreceptor in the image-forming element. When plural image-forming elements are used, the variations of the properties of the photosensitive bodies are large and the color balance of the output image is thus changed. Therefore, the color reproducibility of the input image is lowered as being a lethal problem of the full-color image forming apparatus.

SUMMARY OF THE INVENTION

Accordingly, this invention provides a photoreceptor capable of forming a stable high-quality image suitable for repeated use with high durability. Specifically, this invention provides a photoreceptor that has high durability and is capable of inhibiting residual voltage rise and occurrence of image blur that will otherwise deteriorate the image, and is thus capable of forming a high quality image steadily even after repeated use for long time. Moreover, this invention provides a photoreceptor that is used in an image forming apparatus utilizing the tandem method, and has good color reproducibility even after repeated use.

Moreover, this invention provides an electrophotographic method, an ectrophotographic apparatus and a process cartridge used in electrophotography that use the photoreceptor of this invention, wherein the used photosensitive bodies need not to be exchanged. By using them, high-speed printing is possible and miniaturization of the electrophotographic apparatus can be achieved in accompany with miniaturization of the photoreceptor, and high quality images can be formed steadily even after repeated use.

An electrophotographic photoreceptor disclosed in this invention comprises a photosensitive layer containing at least an organic charge-generating material and an organic charge-conducting material on a conductive support, and a surface layer. The surface layer containing at least two kinds of filler having different volume-averaged grain sizes, wherein the different kinds of filler may comprise the same material or different materials. The fillers in the photosensitive layer have a gradient size distribution where the grain size of the filler continuously increases from the side adjacent to the photosensitive layer toward the surface side. Moreover, the above-mentioned size distribution represents the mixing ratio of at least two kinds of filler having different grain sizes, which is the same in the description hereinafter. Moreover, when the protective layer comprises a single layer, the continuously increasing size distribution means that the mixing ratio of at least two kinds of filler changes continuously in the single-layer protective layer.

Another electrophotographic photoreceptor disclosed in this invention comprises a photosensitive layer containing an organic charge-generating material and an organic charge-transferring material on a conductive support, and a surface layer. The surface layer comprises at least two sub-layers containing fillers of different volume-averaged grain sizes, wherein the fillers of different volume-averaged grain sizes may comprise the same material or different materials. The fillers in the photosensitive layer have a grain size distribution that gradually increases from the side adjacent to the photosensitive layer toward the surface side. Moreover, when the protective layer comprises multiple layers, the gradually increasing size distribution means that the mixing ratio of at least two kinds of filler changes step-by-step in the multiple-layer protective layer.

In the prior art, for an electrophotographic photoreceptor comprising a protective layer and a photosensitive layer containing an organic charge-generating material and an organic charge-conducting material on a conductive support, 3 trade-off relationships are usually observes: 1) the residual voltage is reduced with increasing wear-resistance; 2) the image blur is compelled with increasing wear-resistance; and 3) the resolution is improved with increasing wear-resistance. However, when the used protective layer comprises at least two kinds of filler having different volume-averaged grain sizes with a gradient size distribution (the grain size distribution continuously increases from the side adjacent to the photosensitive layer toward the surface side), it is observed that the 3 trade-off relationships are cleared simultaneously. Therefore, a photoreceptor capable of forming high quality images for repeated use with high durability can be designed. Consequently, an electrophotographic method, an electrophotographic apparatus and a process cartridge used in electrophotography capable of forming high quality images for repeated use with high durability can also be designed.

Similarly, when the protective layer comprises at least two sub-layers containing fillers of different volume-averaged grain sizes with the sub-layer having a larger filler grain size at the outmost surface side and the sub-layer having a smaller filler grain size at the photosensitive layer side, the 3 trade-off relationships are cleared simultaneously. Therefore, a photoreceptor capable of forming high quality images for repeated use with high durability can be designed. Consequently, an electrophotographic method, an electrophotographic apparatus and a process cartridge used in electrophotography capable of forming high quality images for repeated use with high durability can also be designed.

Furthermore, since the protective layer comprises at least two sub-layers containing fillers of different volume-averaged grain sizes with the sub-layer having a larger filler grain size at the outmost surface side and the sub-layer having a smaller filler grain size at the photosensitive layer side, the differences between the electrostatic properties and between the wear resistance of different photosensitivity bodies in the image forming elements can be reduced. Consequently, a full-color image forming apparatus using the tandem method can be designed with good color reproducibility even after repeated use.

The electrophotographic photoreceptor of this invention are further explained in the following preferred embodiments in accompany with drawings. It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
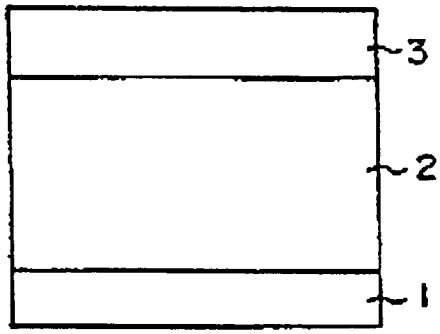
FIG. 1 illustrates a cross-sectional view of an example of the electrophotographic photoreceptor of this invention.

FIG. 1 illustrates a cross-sectional view of an electrophotographic photoreceptor according to a first embodiment of this invention. A single photosensitive layer 2 comprising a charge-generating material and a charge-transferring material as major components is disposed on an electrically conductive support 1 and a protective layer 3 is disposed on the surface of the photosensitive layer 2. The protective layer 3 contains at least two kinds of filler having different volume-averaged grain sizes, wherein the fillers have a gradient grain size distribution, which means that the grain size distribution continuously increases from the support side toward the surface side.

Figure 2:
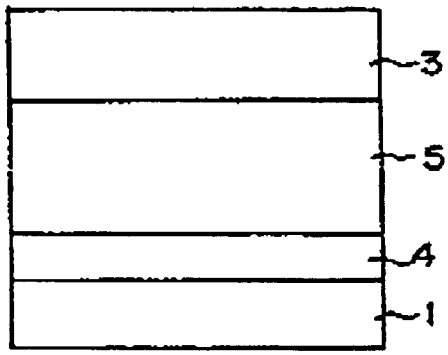
FIG. 2 illustrates a cross-sectional view of another example of the electrophotographic photoreceptor of this invention.

FIG. 2 illustrates a cross-sectional view of an electrophotographic photoreceptor according to a second embodiment of this invention. A laminated structure, which comprises a charge-generating layer 4 based on a charge-generating material and a charge-transferring layer 5 based on a charge-transferring material, is formed on an electrically conductive support 1, and a protective layer 3 is disposed on the charge-transferring layer 5. The protective layer 3 contains at least two kinds of filler having different volume-averaged grain sizes, wherein the fillers have a gradient grain size distribution, which means that the grain size distribution continuously increases from the support side toward the surface side.

Figure 3:
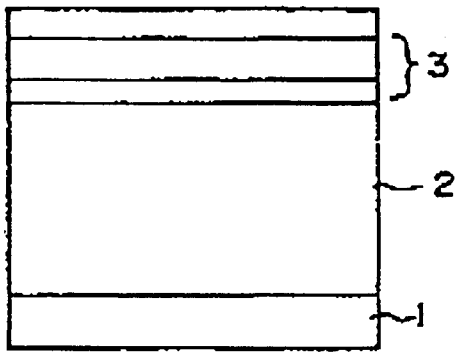
FIG. 3 illustrates a cross-sectional view of still another example of the electrophotographic photoreceptor of this invention.

FIG. 3 illustrates a cross-sectional view of another electrophotographic photoreceptor according to the first embodiment of this invention. A single photosensitive layer 2 comprising a charge-generating material and a charge-transferring layer as major components is disposed on an electrically conductive support 1, and a protective layer 3 is disposed on the surface of the photosensitive layer. The protective layer 3 contains at least two kinds of filler having different volume-averaged grain sizes, wherein the filler grain size distribution increases step by step from the support side toward the surface side.

Figure 4:
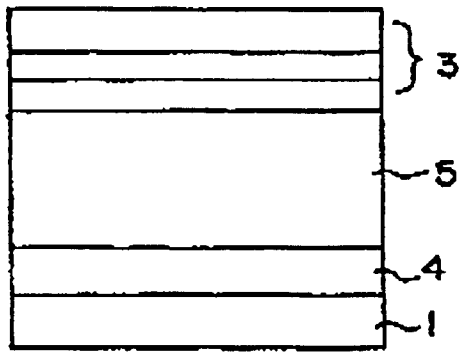
FIG. 4 illustrates a cross-sectional view of still another example of the electrophotographic photoreceptor of this invention.

FIG. 4 illustrates a cross-sectional view of another electrophotographic photoreceptor according to the second embodiment of this invention. A laminated structure, which comprises a charge-generating layer 4 based on a charge-generating material and a charge-transferring layer 5 based on a charge-transferring material, is formed on an electrically conductive support 1, and a protective layer 3 is disposed on the charge-transferring layer 5. The protective layer contains at least two kinds of filler having different volume-averaged grain sizes, wherein the filler grain size distribution increases step by step from the support side toward the surface.

In the electrophotographic photosensitive bodies illustrated in FIG. 1~4, using the same material for the two kinds of filler having different volume-averaged grain sizes is as suitable as using different materials for the two kinds of filler. When the properties of the bulk of the protective layer need not to be varied remarkably, the same material can be used for different kinds of filler to obtain stable properties of the protective layer. On the other hand, when the bulk of the protective layer is set to have low resistance, it is not preferred to use a low-resistance component at the surface side since the image blur phenomenon easily occurs under such a condition. Therefore, by using a material of high specific resistance for the filler having a larger grain size and a material of low specific resistance for the filler having a smaller grain size, i.e., by forming a gradient specific resistance distribution except the gradient grain size distribution, the effects of this invention can be further enhanced.

The conductive support 1 has a conductivity characterized by a volume resistance lower than $10^{10}\Omega\cdot$cm. The conductive support 1 is formed by, for example, evaporating or sputtering a metal like aluminum, nickel, chromium, nichrome, copper, gold, silver and platinum, or a metal oxide like tin oxide and indium oxide to cover a plastic or a paper having a film-like or cylindrical shape. The alternative method is using a plate or the like made from aluminum, aluminum alloy, nickel or stainless steel to fabricate an element tube or the like with a pushing-out method or a drawing method, and then performing surface treatment, such as cutting, super finishing or polishing to the tube. Moreover, the endless nickel belt and the endless stainless belt disclosed in Japanese Patent Application Laid Open No. Sho 52-36016 can also be used as the conductive support 1.

Moreover, among the candidates of the conductive support 1, the cylindrical aluminum-type support to which an anodizing coating treatment can be easily applied is most preferable. Wherein the aluminum-type here means pure aluminum or aluminum alloy. Specifically, the aluminum or the aluminum alloy of JIS-1000, JIS-3000 and JIS-6000 are most preferable. The anodizing coating treatment is performed by anodizing various metals and metal alloys in electrolyte solutions of metal, wherein the so-called Alumite process performed by using aluminum or aluminum alloy is most preferably used in the photoreceptor of this invention. Particularly, such a coating has the advantage of preventing point defects like black spots and swear of the background from occurring when the photoreceptor is used under the inversion phenomenon (negative→positive phenomenon).

The anodization can be conducted in an acidic bath of chromic acid, sulfuric acid, oxalic acid, phosphoric acid, boric acid, or sulfamine acid, etc., wherein the sulfuric acid bath is most preferable. The conditions of the anodization in a sulfuric acid are, for example, a sulfuric acid concentration of 10~20%, a bath temperature of 5~25° C., a current density of $4A/dm^2$, an electrolytic voltage of 5~30V and a processing time of 5~60 minutes, but not restricted to them. The anodizing coating formed with the aforementioned method is porous and has a high resistance so that its surface is quite unstable. Therefore, an aging effect will occur after the fabrication to easily change the physical properties of the anodizing coating. To solve this problem, a sealing treatment is further required for the anodizing coating, including immersing the anodizing coating in an aqueous solution of nickel fluoride or nickel acetate, immersing the anodizing coating in boiling water, and treating the anodizing coating with pressurized water vapor. Among them, immersing the anodizing coating in an aqueous solution of nickel acetate is most preferable. After the sealing treatment, a cleaning treatment is conducted to the anodizing coating with a main target of removing the excess metallic salts or the like adsorbed during the sealing treatment. Not only the excess impurities remaining on the surface of the support (the anodizing coating) will adversely affect the quality of a subsequent coating film formed thereon, but also a residual low-resistance component will easily cause the adverse swear of the background. The cleaning treatment may not comprise only one washing step but may comprise more than one washing steps, wherein the washing liquid used in the final washing step is preferably one that has been purified (deionized) as completely as possible. In addition, the other washing steps preferably include a special step that uses a contact member to wipe clean the anodizing coating physically. The thickness of the anodizing coating formed with the aforementioned procedures is preferably 5~15 $\mu$m. If the thickness of the anodizing coating is smaller than the lower limit of the range, the barrier ability of the anodizing coating is not enough. If the thickness of the anodizing coating is larger than the upper limit of the range, the time constant of the electrode becomes overly large and a residual voltage will occur and the responsibility of the photoreceptor will decrease.

Besides, the aforementioned support may be further coated with a electrically conductive powder dispersed in a suitable binding resin, wherein the electrically conductive powder may comprise the materials use in the conductive support 1. The materials of the conducting powder include carbon black, acetylene black, a metal such as aluminum, nickel, iron, nichrome, copper, zinc and silver, and an electrically conductive metal oxide such as tin oxide and indium tin oxide, etc. In addition, the co-used binder resin may comprise a thermoplastic, thermosetting or photosetting resin, such as polystyrene, styrene-acrylonitrile copolymer, styrene-butadiene copolymer, styrene-anhydrous maleic acid copolymer, polyester, polyvinyl chloride, vinyl chloride-vinyl acetate copolymer, polyvinylacetate, polyvinylidene chloride, polyarylate resin, phenoxy resin, polycarbonate, cellulose acetate resin, ethylcellulose resin, polyvinylbutyral, polyvinylformal, polyvinyltoluene, poly-N-vinylcarbazole, acryl resin, silicone resin, epoxy resin, melamine resin, urethane resin, phenol resin and alkyd resin, etc. Such a charge-transferring layer can be formed by, for example, dispersing the conductive power and the binding resin in a suitable solvent, such as tetrahydrofuran, dichloromethane, methylethylketone and toluene, etc., and then coating the support with the solution.

Moreover, the conductive support 1 of this invention preferably comprises a suitable cylindrical substrate having a layer of polyvinyl chloride, polypropylene, polyester, polystyrene, polyvinylidene chloride, polyethylene, chlorinated gum or Teflon™, etc., thereon. The layer contains the aforementioned powder therein to form a charge-transferring layer like a thermal contractive tube.

What will be described next is the photosensitive layer. The photosensitive layer can be a single layer or a laminated layer, wherein the laminated one comprising a charge-generating layer 4 and a charge-transferring layer 5 is described at first.

The charge-generating layer 4 comprises a charge-generating material as a major component. The charge-generating layer 4 may use well-known charge-generating materials, which are represented by monoazo pigments, bisazo pigments, trisazo pigments, perylene-type pigments, perynone-type pigments, quinacridon-type pigment, quinone-type condensed polycyclic compounds, squaric acid-type dyes, other phthalocyanine-type pigments, naphthalocyanine-type pigments, azulenium salt-type dyes, for example. Each charge-generating material can be used alone or in combination with at least one of other materials.

Among the charge-generating materials, the azo-type pigments and/or the phthalocyanine-type pigments are used effectively. Particularly, the azo-type pigments expressed by formula (I) below and a titanylphthalocyanine-type pigment, especially the one having at least a maximal diffraction peak at 27.2° in Bragg's 2θ diffraction spectrum using CuKα characteristic X-ray with a wavelength of 1.542 Å, can be used effectively.

Formula (I)

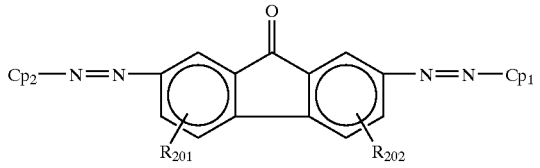

wherein $Cp_1$ and $Cp_2$ are coupler residues and can be the same as well as be different. $R_{201}$ and $R_{202}$ each may be any one of H, a halogen atom, an alkyl group, an alkoxy group and a cyano group and both can be the same as well as be different. Moreover, $Cp_1$ and $Cp_2$ are repressed by formula (II) below.

Formula (II)

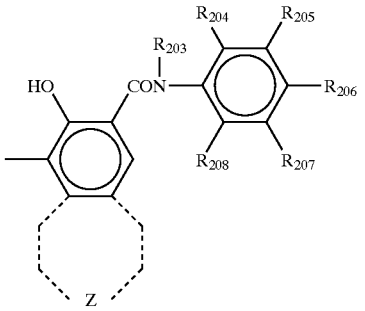

Wherein $R_{203}$ is H, an alkyl group like methyl and ethyl, or an aryl group like phenyl, etc. $R_{204}$, $R_{205}$, $R_{206}$, $R_{207}$, $R_{208}$ each is H, a nitro group, a cyano group, a halogen atom like fluorine (F), chlorine (Cl), bromine (Br) and iodine (I), an alkyl group like trifluoromethyl, methyl and ethyl, an alkoxy group like methoxy and ethoxy, a dialkylamino group, or a hydroxyl group. Z represents a group of atoms necessary for constituting a substituted or unsubstituted aromatic carbocyclic ring or a substituted or unsubstituted aromatic heterocyclic ring.

Particularly, an asymmetric azo-type pigment, in which $C_{p1}$ and $C_{p2}$ have different structures, is generally superior than a symmetric azo-type pigment having $C_{p1}$ and $C_{p2}$ of the same structure in photosensitivity, which corresponds to a higher feasibility of miniaturizing the photoreceptor and a higher speed of the operating process. Therefore, the asymmetric azo-type pigment is used effectively.

Moreover, among the titanylphthalocyanine-type pigments having a maximal diffraction peak at 27.2° in Bragg 2θ diffraction spectrum, the one having a diffraction peak of smallest angle at 7.3° is most preferably used to obtain a high photosensitivity and to decrease the degree of the reduction of the charging ability after repeated use, which is described in Japanese Patent Application Lain Open No. 2001-19871.

To meet some requirements, the charge-generating layer 4 can be formed by dispersing the charge-generating material and a binding resin together in a suitable solvent with a ball miller, an Atliter, a sand mill or supersonic wave, coating the electrically conductive support with the solution, and then drying the solution.

As required, the binding resin used in the charge-generating layer 4 includes, for example, polyamide, polyurethane, epoxy resin, polyketone, polycarbonate, silicone resin, acryl resin, polyvinylbutyral, polyvinylformal, polyvinylketone, polystyrene, polysulfone, poly-N-vinylcarbazole, polyacrylamide, polyvinyl benzal, polyester, phenoxy resin, vinyl chloride-vinyl acetate copolymer, polyvinyl acetate, polyphenylene oxide, polyamide, polyvinylpyridine, cellulose-type resin, casein, polyvinyl alcohol and polyvinylpyrrolidone. The amount of the binding resin is 0~500 parts by weight, preferably 10~300 parts by weight, in proportion to the charge-generating material of 100 parts by weight.

The solvent used for coating includes, for example, isopropanol, acetone, methylethylketone, cyclohexanone, tetrahydrofuran, dioxane, ethylcellosolve, ethyl acetate, methyl acetate, dichloromethane, dichloroethane, monochlorobenzene, cyclohexane, toluene, xylene, ligroin, etc. Particularly, the ketone-type solvents, the ester-type solvents and the ether-type solvents are preferably used. The coating methods using the coating liquids can include dipping coating, spray coating, bead coating, nozzle coating, spinner coating or ring coating.

The thickness of the charge-generating layer 4 is preferably 0.01~5 μm, more preferably 1~2 μm.

The charge-transferring layer 5 can be formed by dispersing the charge-transferring material and a binding resin together in a suitable solvent, coating the charge-generating layer 4 with the solution, and then drying the solution. Moreover, a plasticizer, a leveling agent and an antioxidant can be further added into the solution as required.

The charge-transferring materials include hole-conducting materials and electron-conducting materials. The charge-transferring materials include electron-acceptable materials such as chloranil, bromanil, tetracyanoethylene, tetracyanoquinodimethan, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-1,3,7-trinitrodibenzothiophene-5,5-dioxide and benzoquinone derivatives.

On other hand, the hole conducting materials include other well-known materials, for example, poly-N-vinylcarbazole and the derivatives thereof, poly-γ-carbazolylethylglutamate and the derivatives thereof, pyrene-formaldehyde condensate and the derivatives thereof, polyvinylpyrene, polyvinylphenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbezene derivatives, hydrazone derivatives, indene derivatives, butadiene derivatives, pyrene derivatives, bis-stilbene derivatives and enamine derivatives, etc. Each charge-transferring material can be used alone or in combination with at least one of the other materials.

The binding resins used in the charge-transferring layer 5 includes thermoplastic or thermosetting resins, such as polystyrene, styrene-acrylonitrile copolymer, styrene-butadiene copolymer, styrene-anhydrous maleic acid copolymer, polyester, polyvinyl chloride, vinyl chloride-vinyl acetate copolymer, polyvinyl acetate, polyvinylidene chloride, polyarlate, phenoxy resin, polycarbonate, cellulose acetate resin, ethylcellulose resin, polyvinylbutyral, polyvinylformal, polyvinyltoluene, poly-N-vinylcarbazole, acryl resin, silicone resin, epoxy resin, melamine resin, urethane resin, phenol resin and alkyd resin, etc.

The amount of the charge-transferring material is 20~300 parts by weight, preferably 40~150 parts by weight, in proportion to the binding resin of 100 parts by weight. Moreover, in consideration of the resolution and the responsibility, the thickness of the charge-transferring layer is preferably less than 25 μm. The lower limit of the thickness varies with the conditions of the used system (especially the charging voltage), but is preferably larger than 5 μm.

In this case, the usable solvents include tetrahydrofuran, dioxane, toluene, dichloromethane, monochlorobenzene, dichloroethane, cyclohexanone, methylethylketone and acetone, etc.

The composition of the charge-transferring layer 5 in the photoreceptor of this invention may further comprise a plasticizer or a leveling agent. The plasticizer can be directly a general resin-type plasticizer including dibutylphthalate and dioctylphthalate, and is suitably used in an amount of 0~30 wt % of the binding resin. The leveling agents include silicone oils like dimethylsilicone oil and methylphenylsilicone oil, or a polymer or an oligomer having a perfluoroalkyl group on its side chain, and is suitably used in an amount of 0~1 wt % of the binding resin.

The situation where the photosensitive layer comprises a single layer will be described next. The photoreceptor having the aforementioned charge-generating material in the binding resin can be used. To form the single-layer photosensitive layer, the charge-generating material, the charge-transferring material and the binding resin can be dissolved or dispersed in a suitable solvent. The solution is used to coat the substrate and then dried to form the photosensitive layer. Moreover, it is also feasible to add the aforementioned charge-transferring materials into the photosensitive layer to form a photoreceptor of function separated type, which can be used well. Furthermore, plasticizers, leveling agents and antioxidants, etc., can be added as required.

The binding resin can directly use those used in the charge-transferring layer 5 or a mixture of some binding resins used in the charge-generating layer 4. However, the aforementioned polymeric charge conducting materials can also be used well. In proportion to the binding resin of 100 parts by weight, the amount of the charge-generating material is preferably 5~40 parts by weight and the amount of the charge-transferring material is preferably 0~190 parts by weight, more preferably 50~150 parts by weight. To form the single-layer photosensitive payer, the charge-generating material, the binding resin and the charge conducing material, if required, can be dispersed in a solvent, such as tetrahydrofuran, dioxane, dichloroethane and cyclohexane, etc., by using a disperser. The coating solution thus obtained is applied onto the substrate by using dipping coating, spray coating or bead coating. The thickness of the single-layer photosensitive layer is suitably 5~25 $\mu$m.

In the photoreceptor of this invention, an undercoating layer can be further disposed between the conductive support 1 and the photosensitive layer. The undercoating layer generally comprises a resin as a major component and is preferably applied onto the aforementioned photosensitive layer by using a solvent, while the resins having high solvent resistance to ordinary organic solvents are desired. Such polymers include water-soluble resins like polyvinyl alcohol, casein, sodium polyacrylate, etc., alcohol-soluble resins like copolymerized nylon and methoxymethylated nylon, curable resins that can form 3D crosslinking structures therein, such as polyurethane, melamine resin, phenol resin, alkyd-melamine resin and epoxy resin, etc. Moreover, in order to prevent the Moire phenomenon and to reduce the residual voltage, some fine powder pigments comprising metal oxide such as titanium oxide, silica, alumina, zirconium oxide, tin oxide, indium oxide, etc., can be further added into the undercoating layer.

The undercoating layer can be formed by using a coating method with a proper solvent that can also be used to form the aforementioned photosensitive layer. Moreover, silane coupling agents, titanium coupling agents or chromium coupling agents can be used in the undercoating layer of this invention. Besides, as the material of the undercoating layer of this invention, $Al_2O_3$ formed by using anodization, organic materials like polyparaxylylene (parylene), and inorganic materials like $SiO_2$, $SnO_2$, $TiO_2$, indium tin oxide (ITO) and $CeO_2$ formed by using vacuum film deposition can also be used well. Besides, other well-known materials can also be applied. The thickness of the undercoating layer is suitably 0~5 $\mu$m.

In the photoreceptor of this invention, a protective layer 3 is disposed on the photosensitive layer for protection. The protective layer contains at least two kinds of filler having different volume-averaged grain sizes, wherein the grain size distribution of the filler continuously increases from the support side toward the surface side. By using this design, it is possible to make all advantageous effects compatible, i.e., to simultaneously improve the wear resistance of the surface of the photoreceptor, reduce the residual voltage, increase the transparency, and reduce the image blur defects.

In the other case, the protective layer 3 comprises at least two sub-layers. The protective layer contains at least two kinds of filler having different volume-averaged grain sizes, wherein the filler grain size distribution gradually increases from the support side toward the surface side. By using this design, it is possible to make all advantageous effects compatible, i.e., to simultaneously improve the wear resistance of the surface of the photoreceptor, reduce the residual voltage, increase the transparency and reduce image blur defects.

The concentration of the filler in the protective layer varies with the type of the filler and the conditions of the electrophotographic process using the photoreceptor. At the outmost surface side of the protective layer, the amount of the filler in proportion to the total solid is less than 50 wt %, preferably less than 30 wt %. At the surface of the protective layer closest to the photosensitive layer, the amount of the filler is less than 30 wt %, preferably less than 10 wt %.

Moreover, among the used fillers, the volume averaged grain size of the filler having a larger averaged grain size is preferably 0.1 $\mu$m~2 $\mu$m, more preferably 0.3 $\mu$m~1 $\mu$m. If the averaged grain size is too small, the wear resistance can not be developed sufficiently; if the averaged grain size is too large, the surface nature of the coating layer becomes worse or the coating layer even can not be formed.

Moreover, in this invention, the averaged grain sizes of the fillers, which are bot restricted within the range particularly mentioned above, are measured by an Ultra-Centifugal Automatic Particle Size Distribution Analyzer (CAPA-700 manufactured by HORIBA Ltd.). Then, the specific grain size where the accumulated distribution reaches 50% (Median size) can be calculated. Moreover, it is important that the standard deviation of the sizes of various grains being measured simultaneously should be less than 1 $\mu$m. If the standard deviation of the grain sizes is larger than 1 $\mu$m, the grain size distribution is so broad that the effects of this invention can not be realized obviously.

The mixing ratio of the fillers having different averaged grain sizes is not specifically restricted. However, it is preferred that the ratio of the filler with the larger grain size is larger than 50%, more preferably larger than 70%, in proportion to the total filler amount at the outmost surface side of the protective layer.

The materials used in the protective layer include ABS resin, ACS resin, olefin-vinyl monomer copolymer, chlorinated polyether, allyl resin, phenol resin, polyacetal, polyamide, polyamideimide, polyacrylate, polyallylsulfone, polybutylene, polybutylene terephthalate, polycarbonate, polyarylate, polyether sulfone, polyethylene, polyethylene terephthalate, polyimide, acryl resin, polymethylpentene, polypropylene, polyphenylene oxide, polysulfone, polystyrene, AS resin, butadiene-styrene copolymer, polyurethane, polyvinyl chloride, polyvinylidene chloride, epoxy resin, etc. Among them, polycarbonate or polyarylate is more preferably used.

Moreover, among the filler materials used in the protective layer of the photoreceptor, the organic filler materials include powder of fluoro-resin like polytetrafluoroethylene, silicone resin powder and a-carbon powder. The inorganic filler materials include powder of a metal like copper, tin, aluminum and indium, or powder of a metal oxide like silica, tin oxide, zinc oxide, titanium oxide, indium oxide, antimony oxide, bismuth oxide, tin oxide doped with antimony and indium oxide doped with tin, and potassium titanate, etc. Particularly, in consideration of the hardness of the filler, the inorganic materials are preferably used among all of the aforementioned materials. Specifically, silica and alumina can be used effectively.

Moreover, the pH of the filler, which is one of the requirements of this invention, has great effects on the resolution of the image or on the dispersibility of the filler.

One of the reasons is considered to be that HCl or the like may remain on the filler after the fabrication of the filler, especially the metal oxide filler. If the residual amount is large, the occurrence of the image blur can not be prevented. The residual amount will also affect the dispersibility of the fillers.

Another reason is the charge variation of the surface of the fillers, especially the metal oxide fillers. Usually, the particles dispersed in a liquid have plus charges or minus charges on the surfaces thereof, while the ions having counter charges (the counter ions) gather near the surfaces of the particles to form an electric bilayer, so that the dispersing states of the particles are stabilized. For an electric bilayer system, the potential (Zeta potential) slowly decreases with the increasing distance from the particle and becomes zero at an electrically neutral region where the distance from the particle is sufficiently large. Accordingly, when the absolute value of the Zeta potential is increased, the repulsive force between the particles becomes higher and the stability of the particles are higher, which means that the aggregation of the particles from a distance where the Zeta potential approaches to zero is not stable. On the other hand, the pH of the system will significantly change the Zeta potential and an isoelectric point where the Zeta potential equals zero will form under certain pH. The isoelectric point should be set as far as possible away from the particle by adjusting the pH, so that the absolute value of the Zeta potential can be increased to attain stabilization of the dispersed system.

In the scheme of this invention, the pH of the filler corresponding to the aforementioned isoelectric point is preferably 5 at least to have a merit of inhibiting image blur, while it is noted that the fillers presenting basic tend to have greater effects. As compared with the acidic filler, the filler presents basic with a high pH corresponding to the isoelectric point has a higher Zeta potential, an improved dispersibility and a higher stability of particle.

Here, the pH of the filler of this invention is recorded as the pH corresponding to the isoelectric point of the Zeta potential curve, while he Zeta potential is measured by using the Electrophretic Light Scattering Spectrophotometer (ELS-6000/8000) manufactured by Otsuka Electronics Co., Ltd.

Moreover, in order to prevent the occurrence of image blur, the filler preferably having high electrically insulating ability (specific resistance $>10^{10}\Omega\cdot$cm), while the filler having a pH larger than 5 or a dielectric constant larger than 5 is used particularly effectively. Moreover, except that a filler having a pH larger than 5 or a dielectric constant larger than 5 can be used alone, at least two kinds of filler, among which one (some) has pH larger than 5 but the other(s) does not, can be mixed in use. Similarly, at least tow kinds of filler, among which one (some) has dielectric constants larger than 5 but the other(s) does not, can also be mixed in use. Moreover, among the used fillers, the $\alpha$-alumina having a hexagonal close packed structure with high insulating ability, high thermal stability and high wear resistance is particular effective in inhibiting the image blur or in improving the wear resistance.

In this invention, the specific resistance of the used filler is defined as follows. Since the filler is in the form of powder and the specific resistance varies with the filling ratio of the powder, the specific resistance of the filler must be measured under certain conditions. This invention uses a measuring device having the same structure as that described in Japanese Patent Application Laid Open No. Hei 5-94049 (FIG. 1) and Hei 5-113688 to measure the specific resistance of the filler, and then uses the measured values. In the measuring device, the electrode area is 4.0 $cm^2$. Before the measurement, one side of the electrode is applied with a load of 4 kg for 1 minute and the distance of the electrodes is maintained at 4 mm, and the amount of the sample is thus adjusted. During the measurement, the top electrode is applied with a load of 1 kg and the applied voltage is 100V. When the specific resistance exceeds $10^6\Omega\cdot$cm, the measurement can be done by using HIGH RESISTANCE METER (by Yokogawa HEWLETT PACKARD), otherwise a digital multimeter (Fluke) is used. The specific resistance such determined is defined as the specific resistance mentioned in the description of this invention.

The dielectric constant of the filler is measured with the method described below. The same cell as in the measurement of the specific resistance is used, a load is applied and then an electrostatic capacitance is measured, and the dielectric constant is thereby determined. The electrostatic capacitance is measured by using a Dielectric loss measuring set TR-10C manufactured by Ando Electric Co., Ltd.

Moreover, the filler can be subjected to a surface treatment with at least one surface-treating agent to have a higher dispersibility. If the dispersibility of the filler is low, the residual voltage rises, the transparency of the coating decreases, the coating defects occur and the wear resistance decreases. This will cause severe problems that obstruct the achievement of high durability and high resolution. The surface-treating agent can be any of those used in the prior art, but is preferably one that can maintain the insulating ability of the filler. The surface treatment includes the treatment with titanate-type coupling agents, aluminum-type coupling agents, zircoaluminate-type coupling agents or higher aliphatic acids, and a hybrid treatment with aforementioned agents and silane coupling agents. The surface treatment also includes the treatment with $Al_2O_3$, $TiO_2$, $ZrO_2$, silicone or aluminum stearate, and a hybrid treatment with at least two of the aforementioned agents. Thus the dispersibility of the filler and the image blur problem can be improved. The reason that the silane coupling agents are used in combination with another surface treating agent is that a surface treatment using only silane coupling agents has strong effects on the occurrence of the image blur, and the addition of any other surface treating agent mentioned above can inhibit the effects. The amount of the surface treatment varies with the mean primary grain size and is preferably 3~30 wt %, more preferably 5~20 wt %. If the surface treating amount is less than the lower limit, the dispersing effect of the filler can not be obtained, while an surface treating amount exceeding the upper limit will cause the rise of the residual voltage. Moreover, each filler material can be used alone or in combination with at least one of the other filler materials. The surface-treating amount of the filler is defined as the weight ratio of the surface-treating agent to the filler.

The filler material is dispersed by using a suitable disperser. Moreover, in order to maintain the transparency of the protective layer, the used filler is dispersed to the primary particle level and preferably has few aggregates.

The multi-layer protective layer having a step-like gradient grain size distribution is usually formed by using coating methods. Among the methods, the spray methods are effective methods, wherein two of the more preferable methods are described as follows. In the first method, a plurality of coating liquids having different filler ratios are prepared and then sprayed onto the substrate sequentially to form multiple layers, wherein a layer is formed on a previous layer after the previous layer is completely tack free. In this case, it is required to provide a plurality of spray heads according to the number of the coating liquids, so as to proceed the coating continuously. In the second method, a plurality of spray heads are provided according to the number of the filler species and each kind of filler is used alone to prepare a dispersing liquid. The discharge amount of each dispersing liquid is varied from the layer at the photosensitive layer side to the layer at the surface side of the protective layer, so as to form a step-like gradient grain size distribution.

The single-layer protective layer having a continuous grain size distribution is usually formed by using coating methods. Among the methods, the spray methods are effective methods, wherein two of the more preferable methods are described as follows. In the first method, a plurality of coating liquids having different filler ratios are prepared and then sprayed onto the substrate sequentially, wherein a layer is formed on a previous layer before the previous coating liquid is tack free. In the second method, a plurality of spray heads are provided according to the number of the filler species and each kind of filler is used alone to prepare a dispersing liquid. The discharge amount of each dispersing liquid is varied from the layer at the photosensitive layer side to the layer at the surface side of the protective layer, so as to form a continuous gradient grain size distribution.

Moreover, the protective layer 3 also preferably contains charge-transferring materials in order to reduce the residual voltage and to improve the responsibility. The charge conductive materials can be those mentioned in the description of the charge-transferring layer. When the charge-transferring material is a low molecular charge-transferring material, it is also feasible to make the material has a gradient concentration distribution in the protective layer. To improve the wear resistance, it is an effective way to use a low concentration of the low molecular charge-transferring material at the surface side. Here the concentration is defined as the weight ratio of the low molecular charge-transferring material to all of the materials that constitute the protective layer, and the gradient concentration distribution means that the concentration represented by the weight ratio is set to be lower at the surface side.

Moreover, the protective layer preferably comprises polymeric charge-transferring materials that can serves as a charge-transferring material as well as a binder resin. The protective layer comprising polymeric charge-transferring materials can have an excellent wear resistance, wherein the polymeric charge-transferring materials can be well-known materials. Particularly, a polycarbonate compound that has a triarylamine group at its main chain and/or side chain can be used well. Among such compounds, the polymeric charge-transferring materials represented by formulae (III)~(XII) can be used well. These compounds are illustrated below as examples of this invention.

Formula (III)

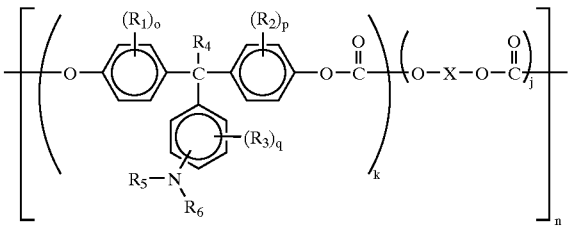

Wherein $R_1$, $R_2$ and $R_3$ each represents a substituted or unsubstituted alkyl group, or a halogen atom. $R_4$ is H or a substituted or unsubstituted alkyl group. $R_5$ and $R_6$ each represents a substituted or unsubstituted aryl group, o, p and q each is an integer of 0~4, and k and j are the composition ratios of the two groups, respectively, with $0.1 \leqq k \leqq 1$ and $0 \leqq j \leqq 0.9$, and n is the number of the repeating units and is an integer of 5~5000. X represents an aliphatic bivalent group, a cycloaliphatic bivalent group, or a bivalent group having the general formula illustrated below.

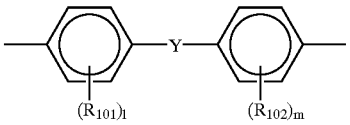

wherein $R_{101}$ and $R_{102}$ each represents a substituted or unsubstituted alkyl group or aryl group, or a halogen atom, and l and m each is an integer of 0~4. Y is a single-bond straight, branched or cyclic $C_1$~$C_{12}$ alkylene group, —O—, —S—, —SO—, —$SO_2$—, —CO—, —CO—O—Z—O—CO— (Z is an aliphatic bivalent group), or the bivalent group illustrated below.

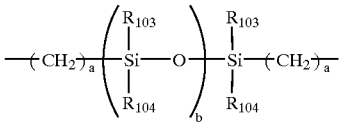

wherein a is an integer of 1~20, b is an integer of 1~2000, and $R_{103}$ and $R_{104}$ each represents a substituted or unsubstituted alkyl group or aryl group. $R_{101}$ and $R_{102}$ can be the same as well as be different, and $R_{103}$ and $R_{104}$ can be the same as well as be different.

Formula (IV)

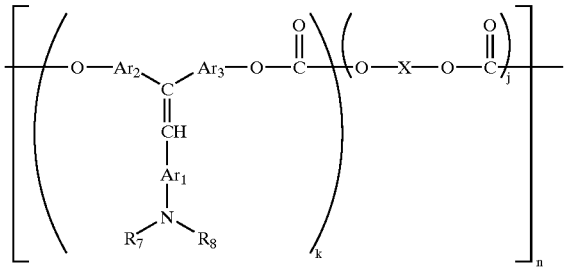

wherein $R_7$ and $R_8$ each represents a substituted or unsubstituted aryl group, $Ar_1$, $Ar_2$ and $Ar_3$ are the same arylene group or different arylene groups, and X, k, j and n are defined as in the description of Formula (III).

Formula (V)

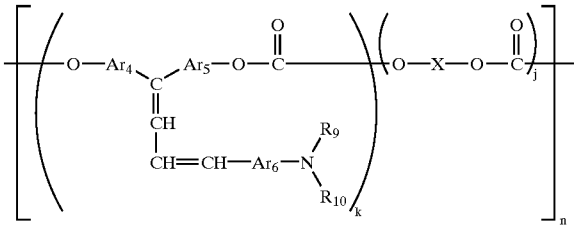

wherein $R_9$ and $R_{10}$ each represents a substituted or unsubstituted aryl group, $Ar_4$, $Ar_5$ and $Ar_6$ are the same arylene group or different arylene groups, and X, k, j and n are defined as in the description of Formula (III).

Formula (VI)

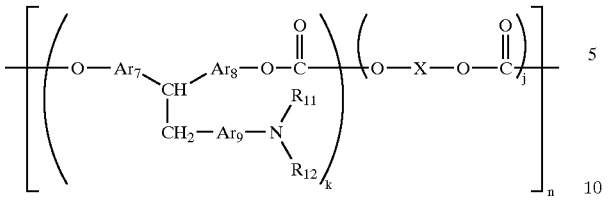

wherein $R_{11}$ and $R_{12}$ each represents a substituted or unsubstituted aryl group, $Ar_7$, $Ar_8$ and $Ar_9$ are the same arylene group or different arylene groups, and X, k, j and n are defined as in the description of Formula (III).

Formula (VII)

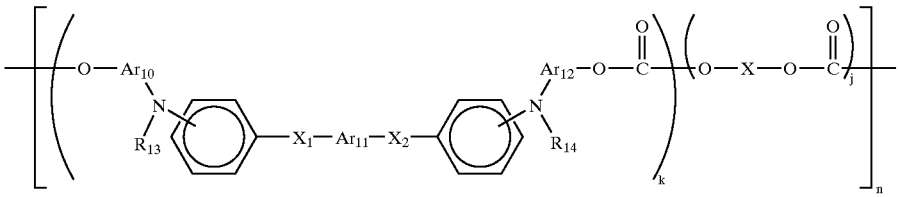

wherein $R_{13}$ and $R_{14}$ each represents a substituted or unsubstituted aryl group, $Ar_{10}$, $Ar_{11}$ and $Ar_{12}$ are the same arylene group or different arylene groups, $X_1$ and $X_2$ each represents a substituted or unsubstituted ethylene group or a substituted or unsubstituted vinylene group, and X, k, j and n are defined as in the description of Formula (III).

Formula (VIII)

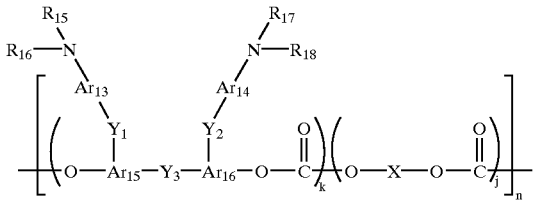

wherein $R_{15}$, $R_{16}$, $R_{17}$ and $R_{18}$ each represents a substituted or unsubstituted aryl group, $Ar_{13}$, $Ar_{14}$, $Ar_{15}$ and $Ar_{16}$ are the same arylene group or different arylene groups, $Y_1$, $Y_2$ and $Y_3$ each represents a substituted or unsubstituted alkylene group, a substituted or unsubstituted cycloalkylene group, a substituted or unsubstituted alkylene ether group, an oxygen atom, a sulfur atoms or a vinylene group, and X, k, j and n are defined as in the description of Formula (III). In addition, $Y_1$, $Y_2$ and $Y_3$ can be the same as well as be different.

Formula (IX)

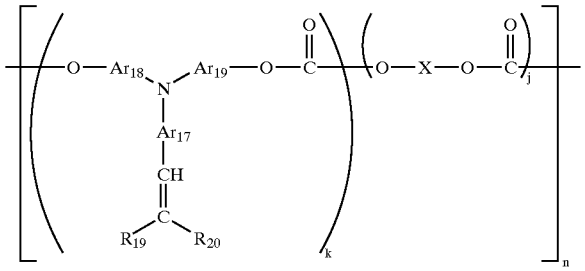

wherein $R_{19}$ and $R_{20}$ each represents H or a substituted or unsubstituted aryl group, but $R_{19}$ and $R_{20}$ together may form a ring alternatively. $Ar_{17}$, $Ar_{18}$ and $Ar_{19}$ are the same arylene group or different arylene groups, and X, k, j and n are defined as in the description of Formula (III).

Formula (X)

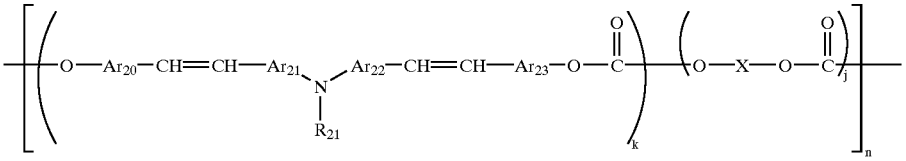

wherein $R_{21}$ represents a substituted or unsubstituted aryl group, $Ar_{20}$, $Ar_{21}$, $Ar_{22}$ and $Ar_{23}$ are the same arylene group or different arylene groups, and X, k, j and n are defined as in the description of Formula (III).

Formula (XI)

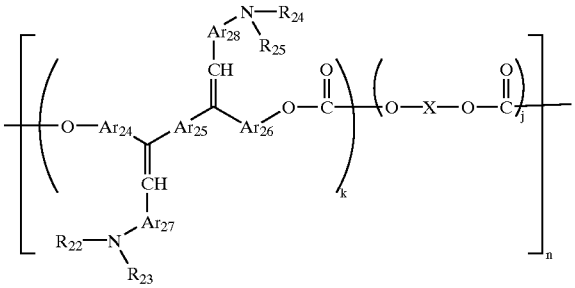

wherein $R_{22}$, $R_{23}$, $R_{24}$ and $R_{25}$ each represents a substituted or unsubstituted aryl group, $Ar_{24}$, Ar25, $Ar_{26}$, $Ar_{27}$ and $Ar_{28}$ are the same arylene group or different arylene groups, and X, k, j and n are defined as in the description of Formula (III).

Formula (XII)

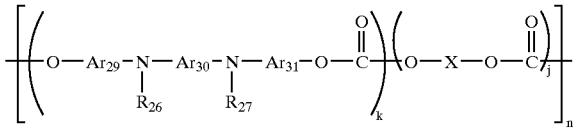

wherein $R_{26}$ and $R_{27}$ each represents a substituted or unsubstituted aryl group, $Ar_{29}$, $Ar_{30}$ and $Ar_{31}$ are the same arylene group or different arylene groups, and X, k, j and n are defined as in the description of Formula (III).

Moreover, except the polymeric charge-transferring materials mentioned above, the polymeric charge-transferring materials that can be used in the protective layer further include those being formed by hardening reactions or crosslinking reactions of monomers or oligomers after the film is formed and therefore having 2D or 3D crosslinking structures. The monomers or the oligomers have electron-donating groups and are present as the protective layer is being formed.

The protective layer comprising the polymer having electron-donating groups thereon or the polymer having crosslinking structures is superior in the wear resistance. Generally, because the charging voltage (voltage at the unexposed region) has a certain value in an electrophotographic process, the surface layer of the photoreceptor will be worn easily after repeated use and the electric field at the unexposed region of the photoreceptor will increase. Since the occurring frequency of swear of the background increases in accompany with an increasing strength of electric field, a higher wear resistance of the photoreceptor is advantageous in reducing swear of the background. Moreover, because the protective layer comprising the polymer having electron-donating groups is a high molecular compound itself, the film-forming property of it is better. Therefore, as compared with the protective layer formed by low molecular compounds or dispersed polymers, such a protective layer can constitute a electrically conductive part with a high density and can have a superior charge conducting ability. Consequently, it can be expected that the photoreceptor having a protective layer using a polymeric charge-transferring material has a high-speed responsibility.

The polymers having electron-donating groups include the polymers formed from well-known monomers, block polymers, graft polymers and star polymers. In addition, the crosslinking polymers having electron-donating groups disclosed in Japanese Patent Application Laid Open No. Hei 3-109406, No. 2000-206723 and No. 2001-34001 may also be used.

In the photoreceptor of this invention, an intermediate layer can be further disposed between the photosensitive layer and the protective layer. The intermediate layer can use a general binder resin as a major component. The binder resins include, for example, polyamide, alcohol-soluble nylon, water-soluble polyvinylbutyral, polyvinylbutyral and polyvinyl alcohol, etc. The intermediate layer is formed by using aforementioned ordinary coating methods and suitably has a thickness of 0.05~2 $\mu$m.

Moreover, in order to improve the environment resistance of the photoreceptor in this invention and to prevent reduction of the sensitivity and rise of the residual voltage, antioxidants, plasticizers, lubricants, UV absorbents, low molecular charge-transferring materials and leveling agents can be further added into each layer. The representatives of these compounds are listed below.

The antioxidants that can be added into each layer include, for example, phenol-type compounds, paraphenylendiamine, hydroquinone, organic sulfur compounds and organic phosphorous compounds, etc.

The plasticizers that can be added into each layer include, for example, phosphoric ester-type plasticizers, phthalic ester-type plasticizers, aromatic carboxylic ester-type plasticizers, aliphatic dibasic acid ester-type plasticizers, fatty acid ester derivatives, oxyacid ester-type plasticizers, epoxy plasticizers, dihydric alcohol ester-type plasticizers, chlorine-containing plasticizers, polyester-type plasticizers, sulfonic acid derivatives, citric acid derivatives, terphenyl, partially hydrogenated terphenyl, camphor, 2-nitrodiphenyl, dinonylnaphthalene and methyl abietate, etc.

The lubricants that can be added into each layer include, for example, hydrocarbon compounds, fatty acid-type compounds, fatty acid amide-type compounds, ester-type compounds, alcohol-type compounds, metallic soap, natural waxes, silicone compounds and fluoro-compounds, etc.

The UV absorbents that can be added into each layer include, for example, benzophenone-type compounds, salcilate-type compounds, benzotriazol-type compounds, cyanoacrylate-type compounds, quenchers (metallic complex) and HALS (hindered amine) compounds, etc.

Figure 5:
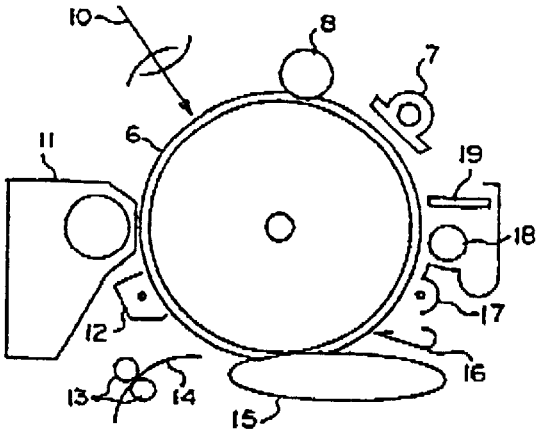
FIG. 5 is a schematic drawing for explaining the electrophotographic apparatus of this invention.

The electrophotographic method and the electrophotographic apparatus of this invention are described with subsequent drawings. Refer to FIG. 5, which illustrates a schematic view of a electrophotographic apparatus and a electrophotographic method of this invention for explanation. The modifications described below are also within the scope of this invention.

The photoreceptor 6 in FIG. 5 has at least a photosensitive layer and a plurality of protective layer disposed on a electrically conductive support, wherein the protective layers as a whole have a specific grain size distribution attributed to at least two kinds of fillers that have different averaged grain sizes. Alternatively, at least a photosensitive layer and a protective layer are disposed on the conductive support, wherein the protective layer has a gradient mixing ratio variation of at least two kinds of filler that have different averaged grain sizes. The photoreceptor 6 can be made in a drum-like shape as in the drawing, as well as in a sheet-like shape or an endless belt-like shape. The charging member 8, the pre-transfer charger 12 and the pre-cleaning charger 17 each can be an early well-known device like a corotron, a scorotron, a solid-state charger and a charging roller. The charging member is preferably disposed contacting or proximal to the photoreceptor.

Here, the charging member of contacting type is a type of charging member which has a surface in contact with the surface of the photoreceptor. The charging member can be made in a shape of a charging roller, a charging blade or a charging brush, wherein the charging roller and the charging brush are preferably used.

Figure 9:
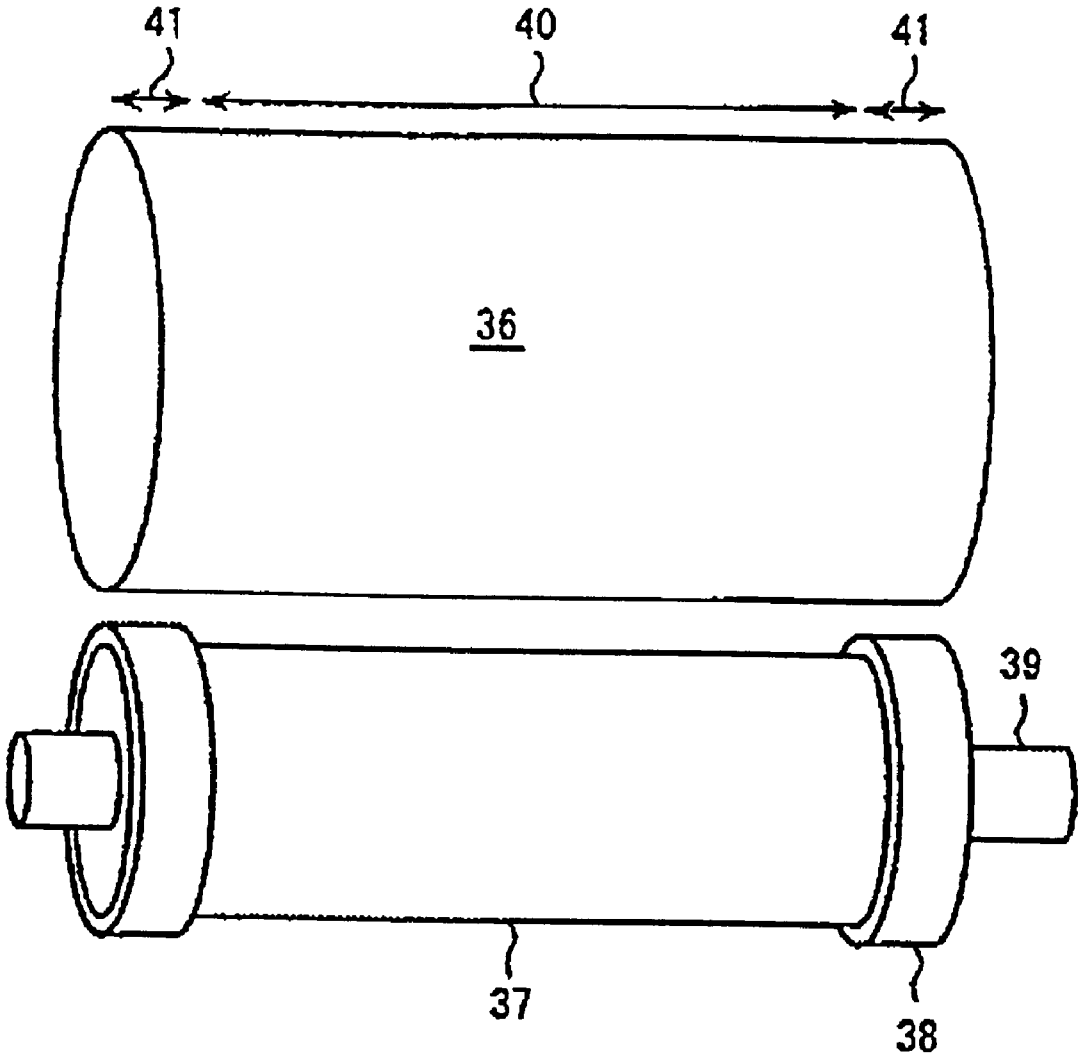
FIG. 9 schematically illustrates a non-contacting charging mechanism in which gap maintaining mechanism is formed on the sides of the charging member.

On the other hand, the proximally disposed charging member is a type of charging member that is disposed proximal to the photoreceptor without contacting it, wherein a gap between the surfaces of the photoreceptor and the charge member is narrower than 200 $\mu$m. The width of the gap varies with the types of the aforementioned well-known chargers. For example, the gap width for a corotron charger is different from that for a scorotron charger. The proximally disposed charging member used in this invention is also preferably made in a shape that has a mechanism capable of moderately controlling the gap width between the surfaces of the photoreceptor and the charging member. For example, the rotating shafts of the photoreceptor and the charging member both can be fixed mechanically with the charging member being disposed apart from the photoreceptor by a moderate gap distance. Among such charging members, the charging member made in a shape of a charging roller can be made with gap forming members to meet the requirement. The gar forming members are disposed at two ends of the charging member not corresponding to the image forming region to contact with the surface of the photoreceptor and thereby render the image forming region in a non-contact arrangement. Alternatively, the photoreceptor can be made with gap forming members disposed at two ends thereof without image formation to contact with the surface of the charging member and thereby render the image-forming region in a non-contact arrangement. Both methods are simple methods for stably maintaining the gap distance. FIG. 9 illustrates one example of the proximity-type charging mechanisms that has two gap forming members disposed at the ends of the charging member.

Moreover, when the photosensitive part is being charged with the charging member, it is possible to have an effect of reducing charge unevenness if the charging member provides an electric field with a direct current (DC) component superimposed by an alternating current (AC) component,.

Generally, any of the aforementioned chargers can be use in a transferring device, while it is effective to use a transfer charger and a separating charger together. Moreover, the light sources used in the image exposing member 10 and the discharging lamp 7 can be any of the following illuminants: fluorescent lamps, tungsten lamps, halogen lamps, mercury lamps, sodium lamps, light emitting diodes (LED), semiconductor laser (laser diode, LD) and electroluminescent illuminants, etc. Meanwhile, in order to make the irradiating light have a desired wavelength range, various filters can be further used, including sharp-cut filters, bandpass filters, infrared-cut (IR-cut) filters, dichroic filters, interference filters and color conversion filters, etc.

Except the process illustrated by FIG. 5, such light sources can also be used in the other processes requiring light irradiation to irradiate the photoreceptor with light, including the transferring process, the discharging process, the cleaning process and the pre-exposing process.

In addition, when the toner developed on the photoreceptor 6 by using the developing unit 11 is being transferred onto a transfer paper 14, the developed toner will not be transferred completely and a residual toner will remain on the photoreceptor 6. The residual toner can be removed from the photoreceptor 6 by using a fur brush 18 and a blade. The cleaning operation can be carried out by using only a cleaning brush, which can be a well-known brush including a fur brush and a mug fur brush.

In the method of this invention, the electrophotographic photoreceptor is positively (negatively) charged then subjected to the image exposure to form a positive (negative) electrostatic latent image thereon. The latent image is developed by using a toner (charge detecting particles) of negative (positive) polarity to form a positive image or is developed by using a toner (charge detecting particles) of positive (negative) polarity to form a negative image. The developing methods suitably used here can be well-known methods, and the discharging method can also be well-known methods.

Figure 6:
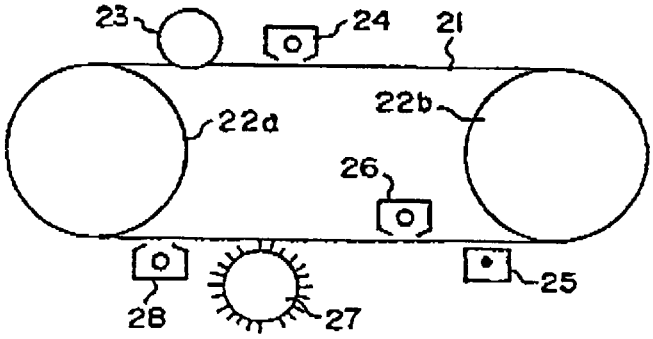
FIG. 6 is a schematic drawing for explaining the electrophotographic process of this invention.

Refer to FIG. 6, which illustrates another example of the electrophotographic processes of this invention. In the photoreceptor 21, at least a photosensitive layer and a plurality of protective layer are disposed on a conductive support, wherein the protective layers as a whole have a specific grain size distribution attributed to at least two kinds of fillers that have different averaged grain sizes. Alternatively, at least a photosensitive layer and a protective layer are disposed on the conductive support, wherein the protective layer has a gradient mixing ratio variation of at least two kinds of fillers that have different averaged grain sizes. The photoreceptor 21 is driven with driving rollers 22*a* and 22*b,* charged with a charging roller 23, and then exposed with a light source 24 to form a latent image. The latent image is then developed (not shown) and transferred from the photoreceptor 21 with a transfer charger 25. The photoreceptor 21 is subjected to a pre-cleaning exposure with a light source 26, cleaned with a brush 27, and then discharged with a light source 28. All of the operations are performed repeatedly. Refer to FIG. 6, the photoreceptor 21 is irradiated from the support side during the pre-cleaning exposure (the support must be transparent, of course).

The electrophotographic processes illustrated by the preceding drawings are only two examples of this invention, while other kinds of processes are also feasible. For example, the irradiating light of the pre-cleaning exposure may not be provided from the support side as in FIG. 6, but be provided from the photosensitive layer side instead. Similarly, the irradiating light of the image exposing operation and the discharging operation can be alternatively provided from the support side. Moreover, except the image exposure, the pre-cleaning exposure and the discharging exposure shown in the drawings, other light irradiating operations may be further performed to irradiate the photoreceptor, including pre-transfer exposure, pre-exposure of the image exposure and other well-known operations, etc.

The aforementioned image forming device can be incorporated and fixed in a copy machine, a facsimile machines or a printer, as well as be incorporated into a device having a shape of a process cartridge. The process cartridge is a single device (part) that contains a built-in photoreceptor and other members including charging members, exposing members, developing members, transferring members, cleaning members and discharging members. The features of the process cartridges like their shapes are widely discussed, while a general example is described below with FIG. 7. In the photoreceptor 33, at least a photosensitive layer and a plurality of protective layer are disposed on a conductive support, wherein the protective layers as a whole have a specific grain size distribution attributed to at least two kinds of filler that have different averaged grain sizes. Alternatively, at least a photosensitive layer and a protective layer are disposed on the conductive support, wherein the protective layer has a gradient mixing ratio variation of at least two kinds of filler that have different averaged grain sizes.

Figure 10:
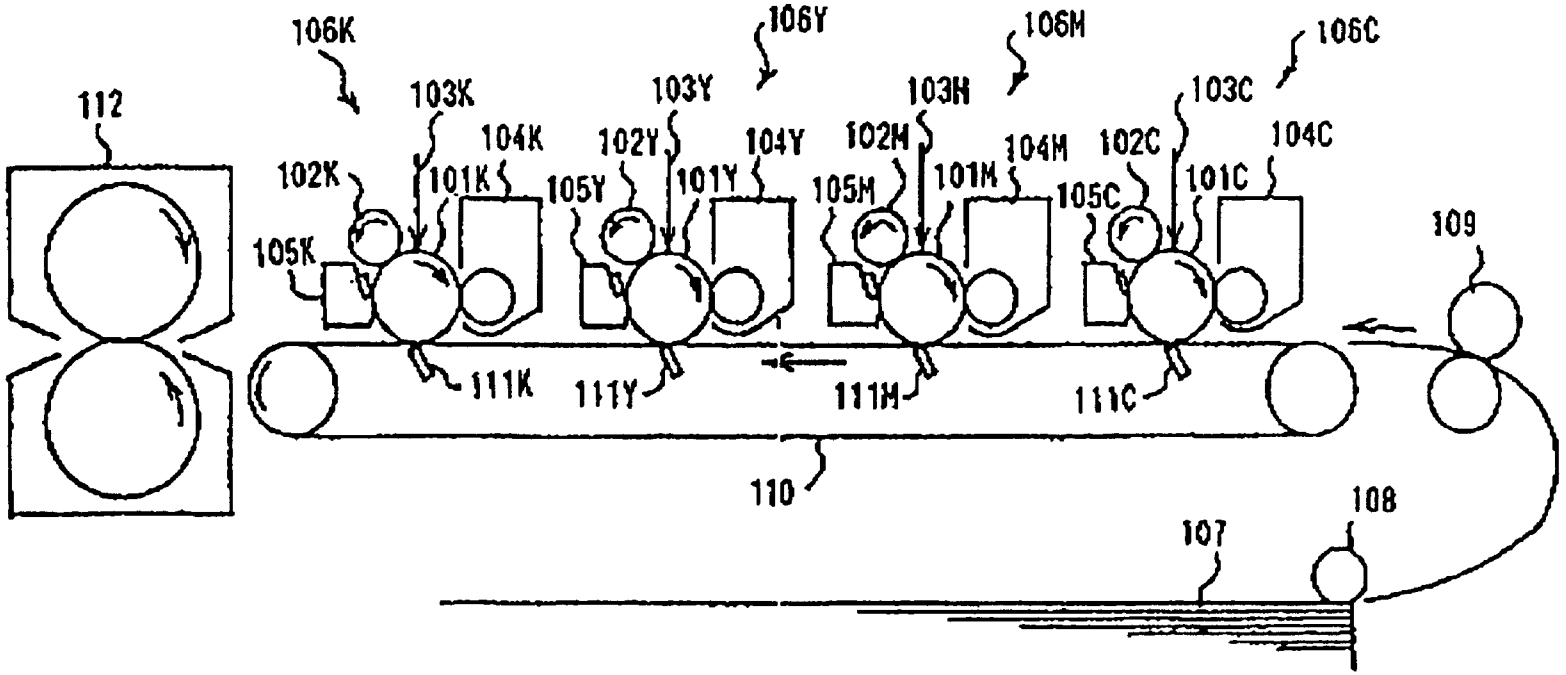
FIG. 10 is a schematic drawing for explaining the full-color electrophotographic apparatus of this invention.

Refer to FIG. 10, which illustrates a schematic view of a full-color electrophotographic apparatus of this invention that uses the tandem method, while the modifications described below are also within the scope of this invention. As shown in FIG. 10, four drum-like photosensitive bodies 101C, 101M, 101Y and 101K each is made rotate in the direction indicated by the arrow. A charging member 102C (102M, 102Y or 102K), a developing member 104C (104M, 104Y or 104K) and a cleaning member 105C (105M, 105Y or 105K) are disposed around the photoreceptor 101C (101M, 101Y or 101K). The charging member 102C (102M, 102Y or 102K) constitutes a charging device capable of uniformly charging the surface of the photoreceptor. A laser beam 103C (103M, 103Y or 103K) is used to irradiate the surface of the photoreceptor 101C (101M, 101Y or 101K) between the charging member 102C (102M, 102Y or 102K) and the developing member 104C (104M, 104Y or 104K) through a exposing member (not shown) to form an electrostatic latent image thereon. Meanwhile, four image forming elements 106C, 106M, 106Y and 106K, each of which comprises a photoreceptor 101C, 101M, 101Y or 101K as a core, are arranged in series along a transfer carrying belt 110 serving as a conveying device of the transfer material. The transfer carrying belt 110 is in contact with the photoreceptor 101C/101M/101Y/101K between the developing member 104C/104M/104Y/104K and the cleaning member 105C/105M/105Y/105K in the image forming elements 106C/106M/106Y/106K. Four transferring brushes 111C, 111M, 111Y and 111K capable of applying transferring biases are disposed on the surface at the inner side of the transfer carrying belt 110 opposite to the photoreceptor side (the inner surface). In addition, since the colors of the toners in the developing devices of the image forming elements 106C, 106M, 106Y and 106K are different, the current waveforms on the charging members 102C, 102M, 102Y and 102K may not be all the same. In this invention, the charging member 102K for forming the black toner image allows the use of a direct current (DC), while the charging members 102C, 102M and 102Y for forming the toner mages of the other colors each allows the use of a alternating field consisting of a DC component and a superimposed alternating current (AC). Other features are all the same for the four charging members 102C, 102M, 102Y and 102K.

The image forming method of the color electrophotographic apparatus having the structure illustrated by FIG. 10 is described as follows. At first, the photosensitive bodies 101C, 101M, 101Y and 101K in the image forming elements 106C, 106M, 106Y and 106K, respectively, are made rotate in the direction indicated by the arrows (the peripheral direction of the photosensitive body) and then charged with the charging members 102C, 102M, 102Y and 102K, respectively. Subsequently, laser light 103C, 103M, 103Y and 103K passing through the exposing members are used to form electrostatic latent images each corresponding to the image of one color. The developing members 140C, 104M, 104Y and 104K are used to develop the latent images to form four toner images. The developing members 140C, 104M, 104Y and 104K perform the development by using a cyan (C) toner, a magenta (M) toner, a yellow (Y) toner and a black (K) toner, respectively. The toner image of each color on the photosensitive bodies 101C, 101M, 101Y and 101K is sequentially superimposed on a transfer paper. The transfer paper 107 is sent forth from a tray by using a paper feed roller 108. Once a pair of resist rollers 109 stops, the transfer paper 107 is conveyed by using the transfer carrying belt 110 following the timing of the image formation on the aforementioned photoreceptor. When the transfer 107 is being conveyed hold on the transfer carrying belt 110, the toner image of each color is transferred onto it from the contacting regions (transfer regions) of the photosensitive bodies 101C, 101M, 101Y and 101K. The toner image on each photoreceptor is transferred onto the transfer paper 107 with an electric field caused by the voltage difference between the voltage of the photoreceptor 101C (101M, 101Y or 101K) and the transfer bias applied by a transfer brush 101C (101M, 101Y or 101K). The transfer paper 107 having passed through the four transfer regions and having the toner images of the four colors superimposed thereon is conveyed to a fixing device 112 to fix the toner thereon and then ejected from a rejecting member (not shown). Moreover, the residual toners that are not transferred from the transfer regions and remain on the photosensitive bodies 101C, 101M, 101Y and 101K are recycled by using four cleaning members 105C, 105M, 105Y and 105K, respectively. Moreover, in spite that the color sequence of the four image forming elements from the upstream side of the transfer paper conveying direction to the downstream side is cyan (C)-magenta (M)-yellow (Y)-black (K) in the example illustrated by FIG. 10, the color sequence is not restricted to that but can be configured to any one. Moreover, when the original image has black color only, it is particularly effective in use to design a mechanism capable of stopping the image forming elements of the other colors. Moreover, when the charging member are applied to the photoreceptor, it is preferred to set a gap with a suitable width of 10~200 $\mu$m between the two to simultaneously decrease the wearing amounts of the two and to decrease the possibility of toner filming on the charger members.

The aforementioned image-forming device can be fixed and incorporated into a copy apparatus, a facsimile or a printer, and each electrophotographic element can also be incorporated into a device having a shape of a process cartridge. The process cartridge is a single device (part) that contains a built-in photoreceptor and other members including a charging member, an exposing member, a developing member, a transferring member, a cleaning member and a discharging member.

Some examples will be described hereinafter to further explain this invention, but they are not intended to restrict the scope of this invention. In addition, the word "part" is defined as "part by weight" in the description hereinafter.

EXAMPLE 1

In this example, an aluminum cylinder is sequentially coated with a coating liquid of an undercoating layer, a coating liquid of a charge-generating layer and a coating liquid of a charge-transferring layer having the compositions described below, wherein a drying step is performed after each coating step. A protective layer is then formed on the charge-transferring layer by using the coating and drying method. Thereby an electrophotographic photoreceptor is formed with an undercoating layer of 3.5 $\mu$m, a charge-generating layer of 0.2 $\mu$m, a charge-transferring layer of 20 $\mu$m and a protective layer of 5 $\mu$m. Moreover, the undercoating layer, the charge-generating layer and the charge-transferring layer are applied by using the immersing coating method and the protective layer is applied by using the spray method.

@ Coating liquid of undercoating layer

| | |
|---|---|
| titanium dioxide powder | 400 parts |
| melamine resin | 65 parts |
| alkyd resin | 120 parts |
| 2-butanone | 400 parts |

@ Coating liquid of charge-generating layer

| | |
|---|---|
| bisazo pigment having a structural formula below | 12 parts |

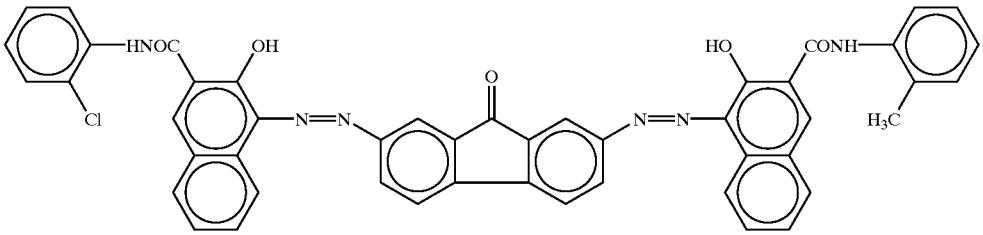

| | |
|---|---|
| polyvinylbutyral | 5 parts |
| 2-butanone | 200 parts |
| cyclohexanone | 400 parts |

@ Coating liquid of charge-transferring layer

| | |
|---|---|
| polycarbonate of type A | 10 parts |
| charge-transferring material having a structural formula below | 8 parts |

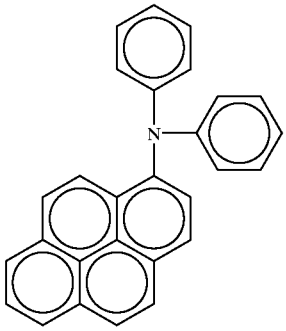

| | |
|---|---|
| tetrahydrofuran | 200 parts |

@ The coating liquid 1 of protective layer

| | |
|---|---|
| polycarbonate of type C | 10 parts |
| charge-transferring material having a structural formula below | 7 parts |

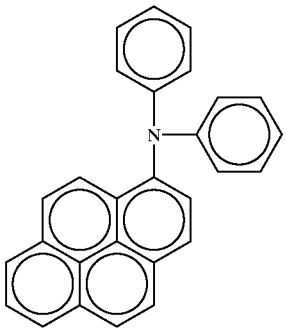

| | |
|---|---|
| alumina particles (specific resistance: $2.5 \times 10^{12}$ Ω · cm, mean primary grain size: 0.2 μm) | 5 parts |
| mean primary grain size: 0.2 μm) | |
| tetrahydrofuran | 400 parts |
| cyclohexanone | 200 parts |

-continued

| | |
|---|---|
| @ Coating liquid 2 of protective layer | 10 parts |
| polycarbonate of type C | |
| charge-transferring material having a structural formula below | 7 parts |

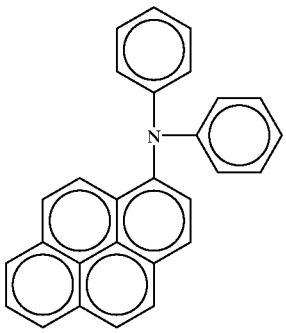

| | |
|---|---|
| alumina particles (specific resistance: $2.5 \times 10^{12}$ Ω · cm, mean primary grain size: 0.2 μm) | 2.5 parts |
| alumina particles (specific resistance: $2.5 \times 10^{12}$ Ω · cm, mean primary grain size: 0.5 μm) | 2.5 parts |
| tetrahydrofuran | 400 parts |
| cyclohexanone | 200 parts |
| @ Coating liquid 3 of protective layer | |
| polycarbonate of type C | 10 parts |
| charge-transferring material having a structural formula below | 7 parts |

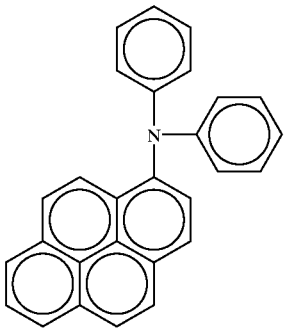

| | |
|---|---|
| alumina particles (specific resistance: $2.5 \times 10^{12}$ Ω · cm, mean primary grain size: 0.5 μm) | 5 parts |
| tetrahydrofuran | 400 parts |
| cyclohexanone | 200 parts |

The coating liquids 1, 2, 3 of the protective layer are used in a way described below. The coating liquid liquids 1, 2 and 3 are sequentially and continuously applied onto the substrate by using three spray heads. Here the word "continuously" means that a layer (from coating liquid 2 or 3) is formed on a previous layer (from coating liquid 1 or 2) by using a spray method before the previous layer is tack free. Moreover, the substrate is coated with corresponding amounts of coating liquids 1,2 and 3 to sequentially form three layers having thickness of 2 μm, 2 μm and 1 μm, respectively. Thereby a protective layer is obtained with total thickness of 5 μm.

EXAMPLE 2

The photoreceptor in this example is fabricated by using the same method as in Example 1, except that the compositions of the three coating liquids 1, 2, and 3 of the protective layer are changed as follows.

@ Coating liquid 1 of protective layer

| | |
|---|---|
| polymeric charge-transferring material having a structural formula below | 7 parts |

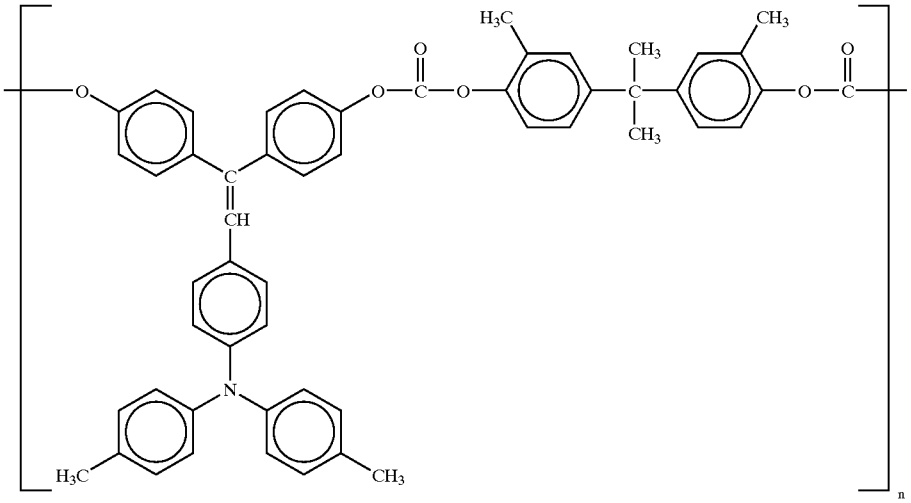

| | |
|---|---|
| alumina particles (specific resistance: $2.5 \times 10^{12}$ Ω · cm, mean primary grain size: 0.2 μm) | 2 parts |
| tetrahydrofuran | 400 parts |
| cyclohexanone | 200 parts |

@ Coating liquid 2 of protective layer

| | |
|---|---|
| polymeric charge-transferring material having a structural formula below | 7 parts |

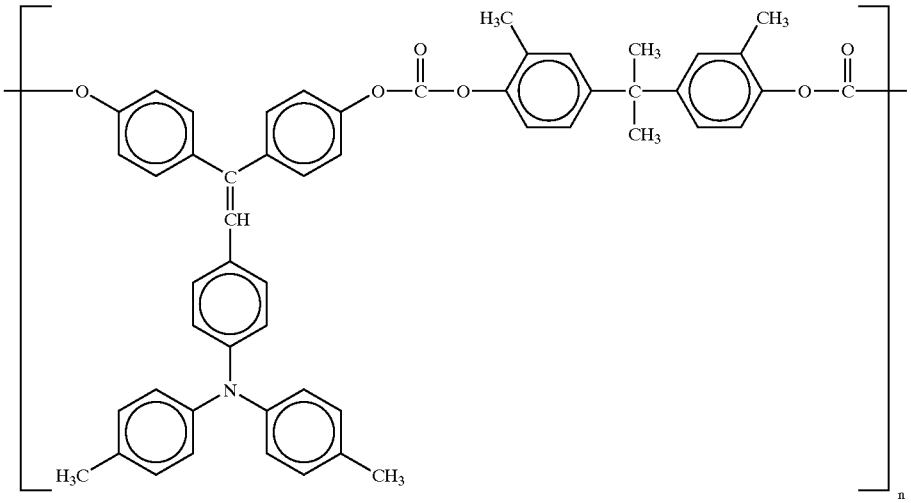

| | |
|---|---|
| alumina particles (specific resistance: $2.5 \times 10^{12}$ Ω · cm, mean primary grain size: 0.2 μm) | 1 part |
| alumina particles (specific resistance: $2.5 \times 10^{12}$ Ω · cm, mean primary grain size: 0.5 μm) | 1 part |
| tetrahydrofuran | 400 parts |
| cyclohexanone | 200 parts |

-continued

@Coating liquid 3 of protective layer polymeric charge-transferring material having a structural formula below 7 parts

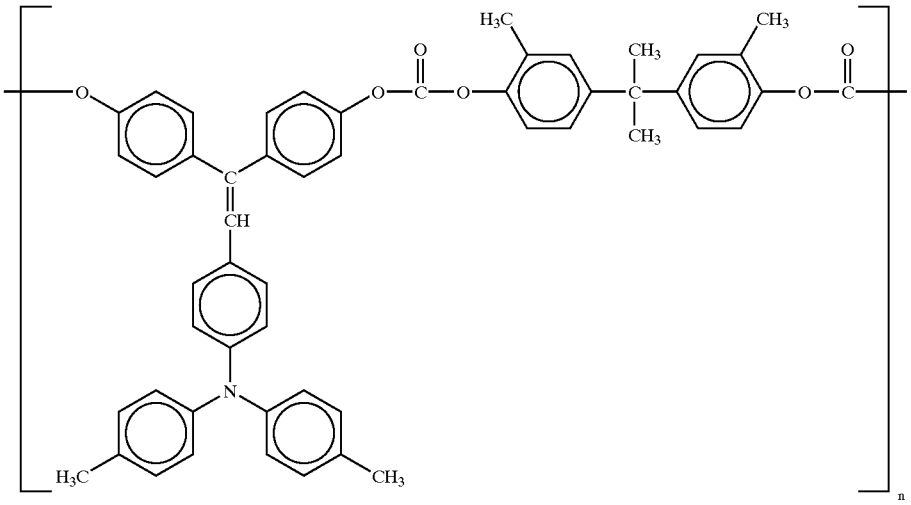

| | |
|---|---|
| alumina particles (specific resistance: $2.5 \times 10^{12}$ Ω · cm, mean primary grain size: 0.5 μm) | 2 parts |
| tetrahydrofuran | 400 parts |
| cyclohexanone | 200 parts |

Comparative Example 1

The photoreceptor in this example is fabricated by using the same method as in Example 1, except that only the coating liquid 1 is used to form a protective layer with a thickness of 5 μm.

Comparative Example 2

The photoreceptor in this example is fabricated by using the same method as in Example 1, except that only the coating liquid 2 is used to form a protective layer with a thickness of 5 μm.

Comparative Example 3

The photoreceptor in this example is fabricated by using the same method as in Example 1, except that only the coating liquid 3 is used to form a protective layer with a thickness of 5 μm.

Comparative Example 4

The photoreceptor in this example is fabricated by using the same method as in Example 2, except that only the coating liquid 1 is used to form a protective layer with a thickness of 5 μm Comparative Example 5

The photoreceptor in this example is fabricated by using the same method as in Example 2, except that only the coating liquid 2 is used to form a protective layer with a thickness of 5 μm.

Comparative Example 6

The photoreceptor in this example is fabricated by using the same method as in Example 2, except that only the coating liquid 3 is used to form a protective layer with a thickness of 5 μm.

Testing Example 1

The photosensitive bodies of Example 1~2 and Comparative Example 1~6 each is used in the electrophotographic process illustrated by FIG. 5 for testing. However, the pre-cleaning exposure is not performed and the charging member is a scorotron charger in this testing example. A semiconductor laser of 655 nm is used as a light source for the image exposure and a polygon mirror is also used to write the image. The photoreceptor is used to print 20,000 sheets continuously, and is evaluated at the initial time and after the printing of 20,000 sheets. Moreover, the wearing amount of the photoreceptor after the printing of 20,000 sheets is also examined. The testing results are shown in Table 1.

TABLE 1

| | Image Quality (initially) | Image Quality (after 20,000 sheets) | Wearing Amount (μm) |
|---|---|---|---|
| Example 1 | good | Good | 1.1 |
| Example 2 | good | Good | 0.9 |
| Comparative Example 1 | good | a few black stripes | 2.0 |
| Comparative Example 2 | good | Resolution down | 1.3 |
| Comparative Example 3 | good | Resolution down | 1.1 |
| Comparative Example 4 | good | a few black stripes | 1.8 |
| Comparative Example 5 | good | Resolution down | 1.2 |
| Comparative Example 6 | good | Resolution down | 1.0 |

EXAMPLE 3

This example use the electrophotographic process illustrated by FIG. 5 as in Example 1, except that the charging member is changed from the scorotron charger to a charging roller, which is disposed in contact with the photoreceptor. The photoreceptor of Example 1 is mounted in the apparatus and the same evaluations are performed with the following charging condition.

Charging condition: DC bias: −850V

The image quality is good after the printing of 20,000 sheets as well as at the initial time. The image has only extremely few abnormalities (swear of the background) recognized after the printing of 20,000 sheets because of the contamination of the charging roller (toner filming). However, the stink of ozone is much weaker during the continuous printing as compared with Example 1.

EXAMPLE 4

In this example, the evaluation is conducted under the same conditions as in Example 3, except that an insulating tape is pasted on two ends of the charging roller used in Example 3. The insulating tape has a thickness of 50 μm and a width of 5 mm to create a spatial gap (50 μm) between the surfaces of the photoreceptor and the charging roller, as shown in FIG. 9. The results of the evaluation show that the contamination of the charging roller recognized in Example 3 is not found completely, and the image quality is good after the printing of 20,000 sheets as we as at the initial time. However, during an output of a halftone image after the printing of 20,000 sheets, extremely little image unevenness is recognized because of the charge unevenness.

EXAMPLE 5

In this example, the evaluation is conducted under the same conditions as in Example 4, except that the charging conditions are changed as follows.

Charging conditions:

DC bias: −850V

AC bias: 1.8 kV (peak to peak), frequency: 1.7 kHz

In this example, the image quality is good after the printing of 20,000 sheets as we as at the initial time. Moreover, the contamination of the charging roller recognized in Example 3 and the halftone image unevenness recognized in Example 4 both are not found.

EXAMPLE 6

A nickel belt is coated sequentially with a coating liquid of an undercoating layer, a coating liquid of a charge-generating layer and a coating liquid of a charge-transferring layer having the compositions described below, wherein a drying step is performed after each coating step. A protective layer is then formed on the charge-transferring layer by using the coating and drying method. Thereby an electrophotographic photoreceptor is formed with an undercoating layer of 3 μm, a charge-generating layer of 0.3 μm, a charge-transferring layer of 22 μm and a protective layer of 3 μm. Moreover, the undercoating layer, the charge-generating layer and the charge-transferring layer are formed by using the immersing coating method and the protective layer is formed by using the spray method.

| | |
|---|---|
| @ Coating liquid of undercoating layer | |
| titanium dioxide powder | 100 parts |
| alcohol-soluble nylon | 100 parts |
| methanol | 500 parts |
| butanol | 300 parts |
| @ Coating liquid of charge-generating layer | |
| bisazo pigment having a structural formula below | 10 parts |

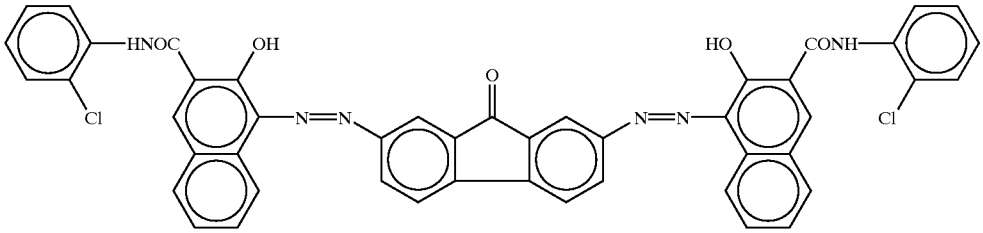

| | |
|---|---|
| polyvinylbutyral | 2 parts |
| 2-butanone | 200 parts |
| cyclohexanone | 400 parts |
| @ Coating liquid of charge-transferring layer | |
| polycarbonate of type Z | 10 parts |
| charge-transferring material having a structural formula below | 7 parts |

-continued

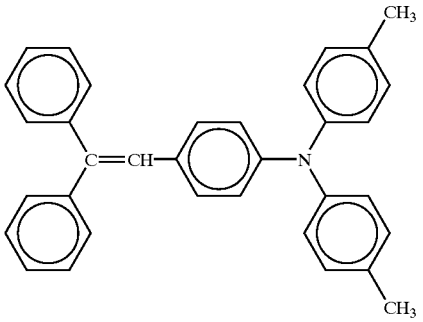

| | |
|---|---|
| tetrahydrofuran | 200 parts |

@ Coating liquid 1 of protective layer

| | |
|---|---|
| polycarbonate of type Z | 10 parts |
| charge-transferring material having a structural formula below | 6 parts |

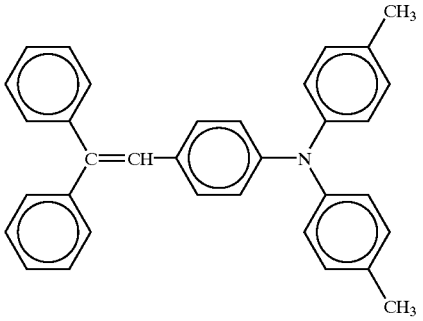

| | |
|---|---|
| titanium oxide particles (specific resistance: $2.5 \times 10^{12}$ Ω · cm, mean primary grain size: 0.1 μm) | 5 parts |
| toluene | 600 parts |

@ Coating liquid 2 of protective layer

| | |
|---|---|
| polycarbonate of type Z | 10 parts |
| charge-transferring material having a structural formula below | 6 parts |

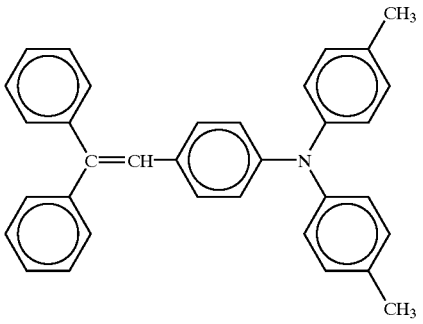

| | |
|---|---|
| titanium oxide particles (specific resistance: $2.5 \times 10^{12}$ Ω · cm, mean primary grain size: 0.1 μm) | 3 parts |
| titanium oxide particles (specific resistance: $2.5 \times 10^{12}$ Ω · cm, mean primary grain size: 0.5 μm) | 2 parts |
| toluene | 600 parts |

@ Coating liquid 3 of protective layer

| | |
|---|---|
| polycarbonate of type Z | 10 parts |
| charge-transferring material having a structural formula below | 6 parts |

-continued

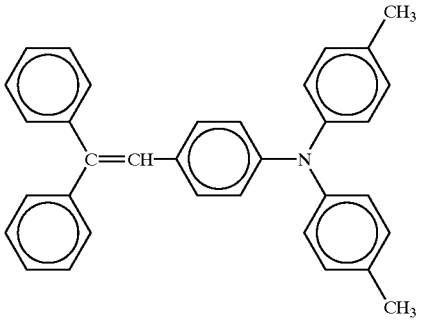

| | |
|---|---|
| titanium oxide particles (specific resistance: $2.5 \times 10^{12}$ Ω · cm, mean primary grain size: 0.5 μm) | 5 parts |
| toluene | 600 parts |

The coating liquids of the protective layer are used in a way described below. The coating liquid liquids 1, 2 and 3 are sequentially and continuously applied onto the substrate by using three spray heads. Here the word "continuously" means that a layer (from coating liquid 2 or 3) is formed on a previous layer (from coating liquid 1 or 2) by using a spray method before the previous layer is tack free. Moreover, the substrate is coated with corresponding amounts of the coating liquids 1, 2 and 3 to sequentially form three layers each having a thickness of 1 μm. Thereby a protective layer is obtained with a total thickness of 3 μm.

EXAMPLE 7

The photoreceptor in this example is fabricated by using the same method as in Example 6, except that the compositions of the three coating liquids 1, 2 and 3 of the protective layer are changed as follows.

@ Coating liquid 1 of protective layer

| | |
|---|---|
| polymeric charge-transferring material having a structural formula below | 7 parts |

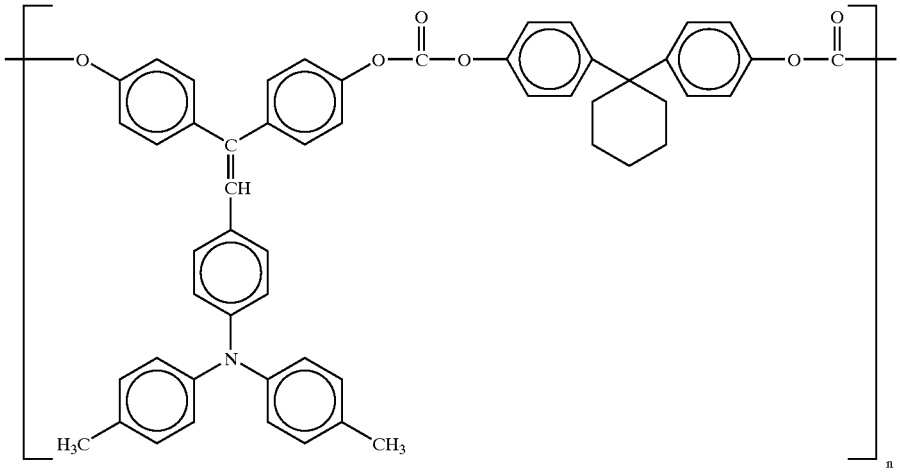

| | |
|---|---|
| alumina particles (specific resistance: $2.5 \times 10^{12}$ Ω · cm, mean primary grain size: 0.3 μm) | 3 parts |
| tetrahydrofuran | 400 parts |
| cyclohexanone | 200 parts |

@ Coating liquid 2 of protective layer

| | |
|---|---|
| polymeric charge-transferring material having a structural formula below | 7 parts |

-continued

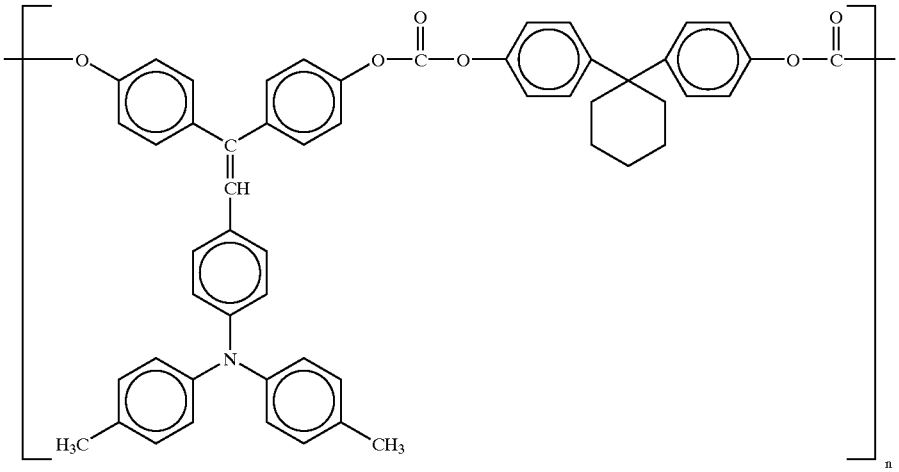

| | |
|---|---|
| silica particles (specific resistance: $4 \times 10^{13}$ Ω · cm, mean primary grain size: 0.5 μm) | 2 part |
| silica particles (specific resistance: $2.5 \times 10^{12}$ Ω · cm, mean primary grain size: 0.3 μm) | 1 part |
| tetrahydrofuran | 400 parts |
| cyclohexanone | 200 parts |
| @ Coating liquid 3 of protective layer | |
| polymeric charge-transferring material having a structural formula below | 7 parts |

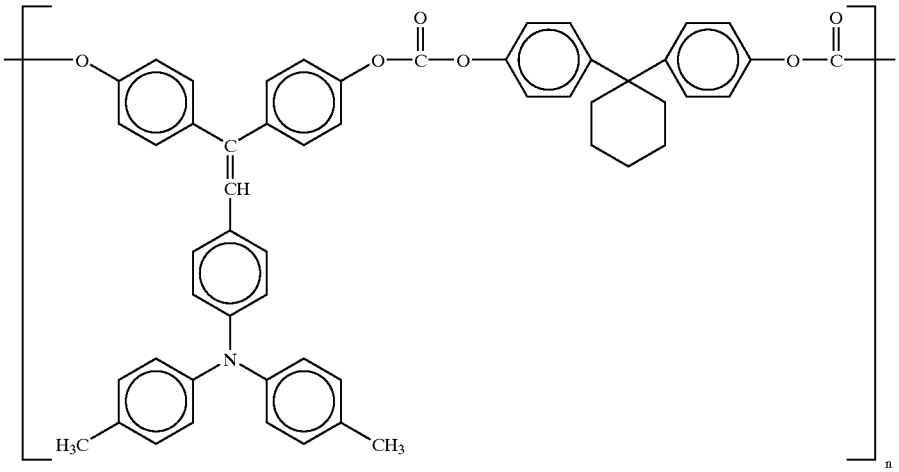

| | |
|---|---|
| silica particles (specific resistance: $4 \times 10^{13}$ Ω × cm, mean primary grain size: 0.5 μm) | 3 part |
| tetrahydrofuran | 400 parts |
| cyclohexanone | 200 parts |

Comparative Example 7

The photoreceptor in this example is fabricated by using the same method as in Example 6, except that only the coating liquid 1 is used to form a protective layer with a thickness of 3 μm.

Comparative Example 8

The photoreceptor in this example is fabricated by using the same method as in Example 6, except that only the coating liquid 2 is used to form a protective layer with a thickness of 3 μm.

Comparative Example 9

The photoreceptor in this example is fabricated by using the same method as in Example 6, except that only the coating liquid 3 is used to form a protective layer with a thickness of 3 μm.

Comparative Example 10

The photoreceptor in this example is fabricated by using the same method as in Example 6, except that the protective layer is not formed and the thickness of the charge-transferring layer is changed to 25 μm.

Comparative Example 11

The photoreceptor in this example is fabricated by using the same method as in Example 7, except that only the coating liquid 1 is used to form a protective layer with a thickness of 3 μm.

Comparative Example 12

The photoreceptor in this example is fabricated by using same method as in Example 7, except that only the coating liquid 2 is used to form a protective layer with a thickness of 3 μm.

Comparative Example 13

The photoreceptor in this example is fabricated by using the same method as in Example 7, except that only the coating liquid 3 is used to form a protective layer with a thickness of 3 μm.

Testing Example 2

The photosensitive bodies of Example 6~7 and Comparative Example 7~13 each is used in the electrophotographic process illustrated by FIG. 6 for testing. However, the pre-cleaning exposure is not performed. A semiconductor laser of 655 nm is used as a light source for the image exposure. The photoreceptor is used to print 30,000 sheets continuously, and is evaluated at the initial time and after the printing of 30,000 sheets. Moreover, the wearing amount of the photoreceptor after the printing of 30,000 sheets is also examined. The testing results are shown in Table 2.

TABLE 2

| | Image Quality (initially) | Image Quality (after 30,000 sheets) | Wearing Amount (μm) |
|---|---|---|---|
| Example 6 | good | good | 1.3 |
| Example 7 | good | good | 1.1 |
| Comparative Example 7 | good | a few black stripes | 2.4 |
| Comparative Example 8 | good | resolution down | 1.4 |
| Comparative Example 9 | good | resolution down | 1.3 |
| Comparative Example 10 | good | swear of the background | 4.3 |
| Comparative Example 11 | good | a few black stripes | 1.9 |
| Comparative Example 12 | good | resolution down | 1.2 |
| Comparative Example 13 | good | resolution down | 1.1 |

EXAMPLE 8

The filler used in Example 6 is subjected to a surface treatment that uses a titanate-type coupling agent with a treating amount of 20%. The filler is then used to formulate the coating liquids 1, 2 and 3 of the protective layer as in Example 6. Thereafter, the averaged size of the grains in the coating liquid is measured by using CAPA700 (manufactured by HORIBA Ltd.) and the precipitability of grains in the coating liquid is evaluated, wherein the coating liquid is placed still in a testing tube and the degree of the precipitation of the grains therein is confirmed with naked eyes. The testing results are shown in Table 3, wherein each test is done to the coating liquid 3 of the protective layer.

EXAMPLE 9

The filler used in Example 6 is subjected to a surface treatment using $Al_2O_3$ with a treating amount of 20%. The filler is then used to formulate the coating liquids 1, 2 and 3 of the protective layer as in Example 6. Thereafter, the averaged size of the grains in the coating liquid is measured by using CAPA700 (manufactured by HORIBA Ltd.) and the precipitability of grains in the coating liquid is evaluated, wherein the coating liquid is placed still in a testing tube and the degree of the precipitation of the grains therein is confirmed with naked eyes. The testing results are also shown in Table 3, wherein each test is done to the coating liquid 3 of the protective layer.

TABLE 3

| Used dispersing Liquid | Average grain size (μm) | Precipitation test |
|---|---|---|
| Example 6 | 0.85 | Grain precipitation recognized after 2 days |
| Example 8 | 0.66 | Grain precipitation recognized after 5 days |
| Example 9 | 0.68 | Grain precipitation recognized after 5 days |

EXAMPLE 10

In this example, the dispersing liquid of Example 8 is used to fabricate a photoreceptor by using the same method as in Example 6. However, the samples for evaluating the transmittance of the protective layer are prepared by forming only the protective layer on a polyester film. The resulting outlook and the surface roughness $R_z$ of the photoreceptor and the transmittance of the protective layer at 665 nm are shown in Table 4.

EXAMPLE 11

In this example, the dispersing liquid of Example 9 is used to fabricate a photoreceptor by using the same method as in Example 6. However, the samples for evaluating the transmittance of the protective layer are prepared by forming only the protective layer on a polyester film. The resulting outlook and the surface roughness $R_z$ of the photoreceptor and the transmittance of the protective layer at 665 nm are also shown in Table 4.

TABLE 4

| Used dispersing liquid | Outlook | $R_z$ (μm) | Transmittance (%) |
|---|---|---|---|
| Example 6 | slightly dull | 0.92 | 86 |
| Example 10 | glossy | 0.63 | 92 |
| Example 11 | glossy | 0.67 | 89 |

EXAMPLE 12

The photoreceptor of Example 10 is mounted in the same evaluating apparatus as in Example 6 and then evaluated for the image quality. The results show that the photoreceptor using the dispersing liquids of Example 8 has a higher resolution as compared with the one using the dispersing liquids of Example 6.

EXAMPLE 13

The photoreceptor of Example 11 is mounted in the same evaluating apparatus as in Example 6 and then evaluated for the image quality. The results show that the photoreceptor using the dispersing liquids of Example 9 has a higher resolution as compared with the one using the dispersing liquids of Example 6.

EXAMPLE 14

An aluminum cylinder is coated sequentially with a coating liquid of an undercoating layer, a coating liquid of a charge-generating layer and a coating liquid of a charge-transferring layer having the compositions described below, wherein a drying step is performed after each coating step. A protective layer is then formed on the charge-transferring layer by using the coating and drying method. Thereby an electrophotographic photoreceptor is formed with a undercoating layer of 3.5 μm, a charge-generating layer of 0.2 μm, a charge-transferring layer of 21 μm and a protective layer of 4 μm.

@ Coating liquid of undercoating layer

| | |
|---|---|
| titanium dioxide powder | 400 parts |
| melamine resin | 65 parts |
| alkyd resin | 120 parts |
| 2-butanone | 400 parts |

@ Coating liquid of charge-generating layer

Figure 8:
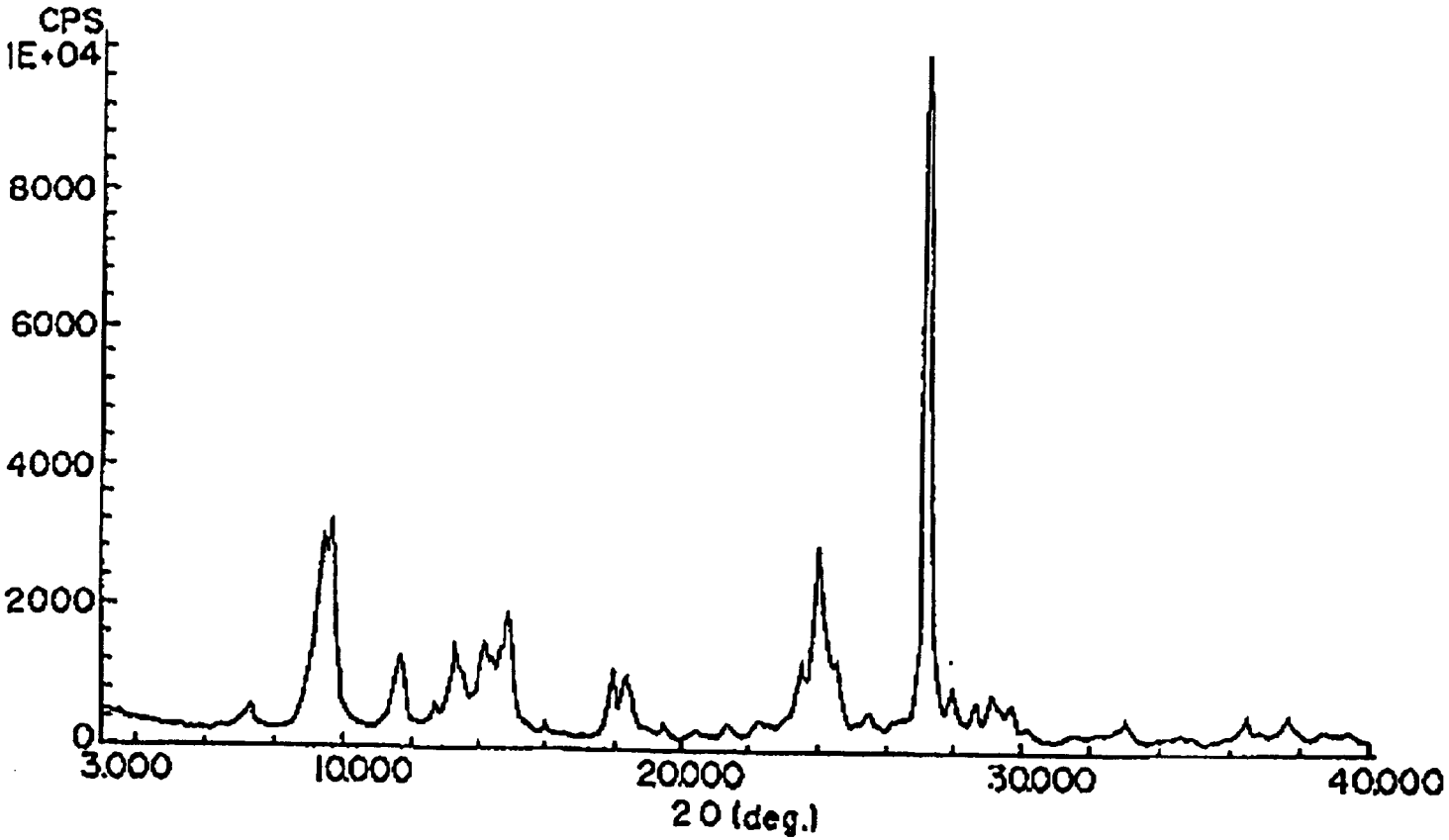
FIG. 8 shows the XD spectrum of the titanylphthalocyanine compound used in Example 14.

| | |
|---|---|
| titanylphthalocyanine having a XD spectrum as shown in FIG. 8 (the titanylphthalocyanine disclosed in Japanese Patent Application No. 2001-19871) | 8 parts |
| polyvinylbutyral | 5 parts |
| 2-butanone | 400 parts |

@ Coating liquid of charge-transferring layer

| | |
|---|---|
| polycarbonate of type Z | 10 parts |
| charge-transferring material having a structural formula below | 7 parts |

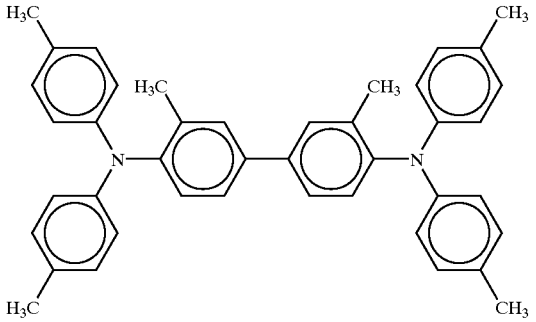

| | |
|---|---|
| dichloromethane | 80 parts |

@ Coating liquid 1 of protective layer

| | |
|---|---|
| polyarylate | 10 parts |
| charge-transferring material having a structural formula below | 8 parts |

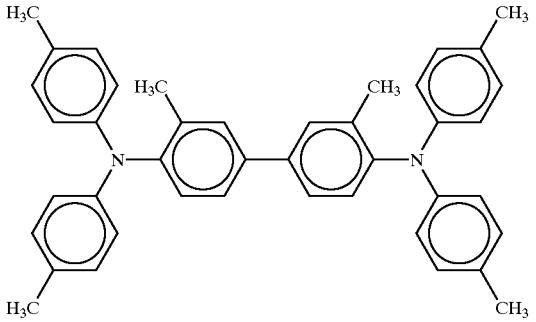

| | |
|---|---|
| alumina particles (specific resistance: $2.5 \times 10^{12}$ Ω · cm, mean primary grain size: 0.2 μm) | 6 parts |
| tetrahydrofuran | 400 parts |
| cyclohexanone | 200 parts |

@ Coating liquid 2 of protective layer

| | |
|---|---|
| polyarylate | 10 parts |
| charge-transferring material having a structural formula below | 8 parts |

-continued

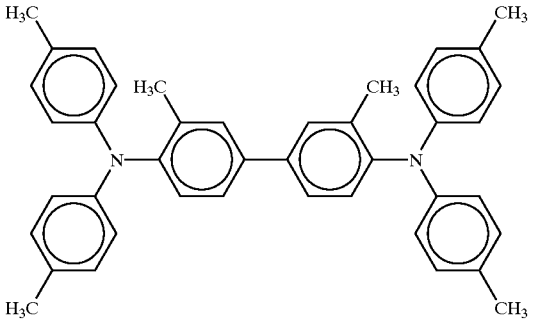

| | |
|---|---|
| alumina particles (specific resistance: $2.5 \times 10^{12}$ Ω · cm, mean primary grain size: 0.2 μm) | 4 parts |
| alumina particles (specific resistance: $2.5 \times 10^{12}$ Ω · cm, mean primary grain size: 0.5 μm) | 2 parts |
| tetrahydrofuran | 400 parts |
| cyclohexanone | 200 parts |
| @ Coating liquid 3 of protective layer | |
| polyarylate | 10 parts |
| charge-transferring material having a structural formula below | 8 parts |

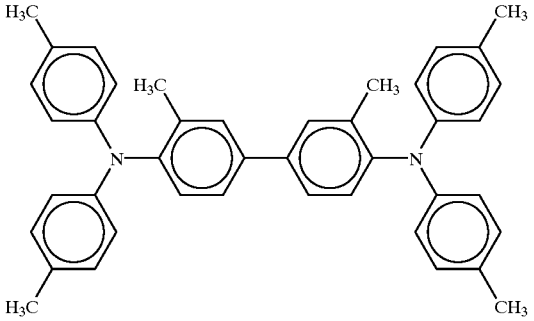

| | |
|---|---|
| alumina particles (specific resistance: $2.5 \times 10^{12}$ Ω · cm, mean primary grain size: 0.5 μm) | 6 parts |
| tetrahydrofuran | 400 parts |
| cyclohexanone | 200 parts |

The coating liquids of the protective layer are used in a way described below. The coating liquid liquids 1, 2 and 3 are sequentially and continuously applied onto the substrate by using three spray heads. Here the word "continuously" means that a layer (from coating liquid 2 or 3) is formed on a previous layer (from coating liquid 1 or 2) by using the spray method before the previous layer is tack free. Moreover, the substrate is coated with corresponding amounts of the coating liquids 1, 2 and 3 to sequentially form three layers having thickness of 1.5 μm, 1.5 μm and 1 μm, respectively. Thereby a protective layer is obtained with a total thickness of 4 μm.

Comparative Example 14

The photoreceptor in this example is fabricated by using the same method as in Example 14, except that only the coating liquid 1 is used to form a protective layer with a thickness of 4 μm.

Comparative Example 15

The photoreceptor in this example is fabricated by using the same method as in Example 14, except that only the coating liquid 2 is used to form a protective layer with a thickness of 4 μm.

Comparative Example 16

The photoreceptor in this example is fabricated by using the same method as in Example 14, except that only the coating liquid 3 is used to form a protective layer with a thickness of 4 μm.

Comparative Example 17

The photoreceptor in this example is fabricated by using the same method as in Example 14 except that the protective layer is not formed and the thickness of the charge-transferring layer is changed to 25 μm.

Testing Example 3

Figure 7:
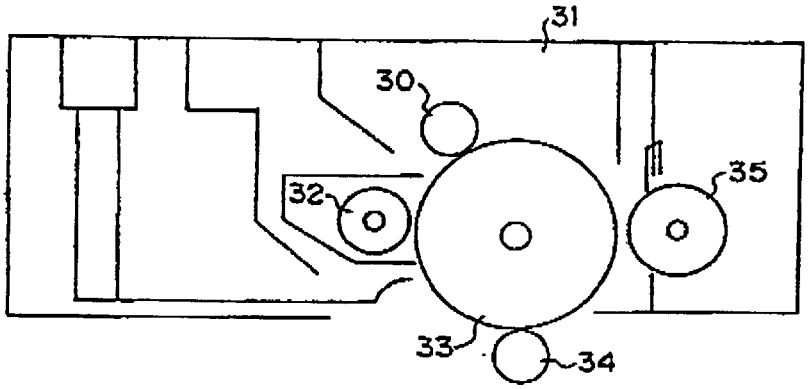
FIG. 7 is a schematic drawing for explaining the process cartridge used in the apparatus of the electrophotographic process of this invention.

The photosensitive bodies of Example 14 and Comparative Example 14~17 each is mounted in a cartridge illustrated by FIG. 7 that is used in an electrophotographic process. A semiconductor laser of 780 nm is used as a light source for the image exposure and a polygon mirror is also used to write the image. The photoreceptor is used to print 20,000 sheets continuously, and is evaluated at the initial time and after the printing of 20,000 sheets. Moreover, the wearing amount of the photoreceptor after the printing of 20,000 sheets is also examined. The testing results are shown in Table 5.

TABLE 5

| | Image Quality (initially) | Image Quality (after 20,000 sheets) | Wearing Amount ($\mu$m) |
|---|---|---|---|
| Example 14 | good | good | 1.0 |
| Comparative Example 14 | good | a few black stripes | 1.9 |
| Comparative Example 15 | good | resolution down | 1.1 |
| Comparative Example 16 | good | resolution down | 1.0 |
| Comparative Example 17 | good | swear of the background | 4.3 |

EXAMPLE 15

An aluminum cylinder is coated sequentially with a coating liquid of an undercoating layer, a coating liquid of a charge-generating layer and a coating liquid of a charge-transferring layer having the compositions described below, wherein a drying step is performed after each coating step. A protective layer is then formed on the charge-transferring layer by using the coating and drying method. Thereby an electrophotographic photoreceptor is formed with a undercoating layer of 3.5 $\mu$m, a charge-generating layer of 0.2 $\mu$m, a charge-transferring layer of 20 $\mu$m and a protective layer of 5 $\mu$m. Moreover, the undercoating layer, the charge-generating layer and the charge-transferring layer are applied by using the immersing coating method and the protective layer is applied by using the spray method.

@ Coating liquid of undercoating layer

| | |
|---|---|
| titanium dioxide powder | 400 parts |
| melamine resin | 65 parts |
| alkyd resin | 120 parts |
| 2-butanone | 400 parts |

@ Coating liquid of charge-generating layer

| | |
|---|---|
| bisazo pigment having a structural formula below | 12 parts |

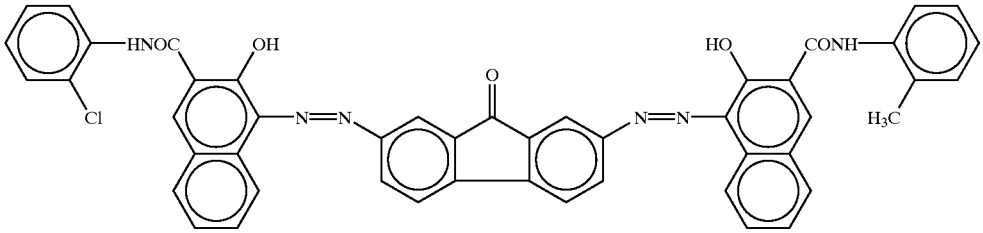

| | |
|---|---|
| polyvinylbutyral | 5 parts |
| 2-butanone | 200 parts |
| cyclohexanone | 400 parts |

@ Coating liquid of charge-transferring layer

| | |
|---|---|
| polycarbonate of type A | 10 parts |
| charge-transferring material having a structural formula below | 8 parts |

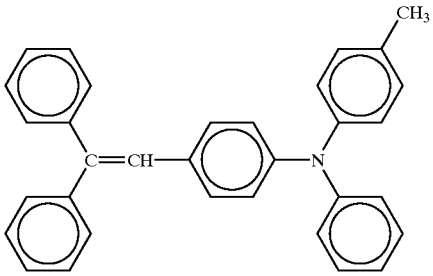

| | |
|---|---|
| tetrahydrofuran | 200 parts |

@ Coating liquid 1 of protective layer

| | |
|---|---|
| polycarbonate of type C | 10 parts |
| charge-transferring material having a structural formula below | 7 parts |

-continued

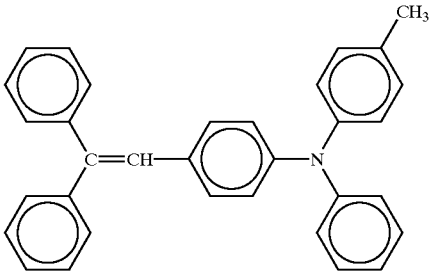

| | |
|---|---|
| alumina particles (specific resistance: $2.5 \times 10^{12}$ Ω · cm, mean primary grain size: 0.2 μm) | 5 parts |
| tetrahydrofuran | 400 parts |
| cyclohexanone | 200 parts |
| @ Coating liquid 2 of protective layer | |
| polycarbonate of type C | 10 parts |
| charge-transferring material having a structural formula below | 7 parts |

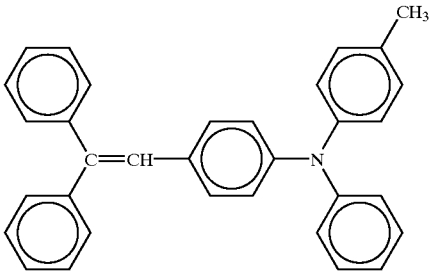

| | |
|---|---|
| alumina particles (specific resistance: $2.5 \times 10^{12}$ Ω · cm, mean primary grain size: 0.2 μm) | 2.5 parts |
| alumina particles (specific resistance: $2.5 \times 10^{12}$ Ω · cm, mean primary grain size: 0.5 μm) | 2.5 parts |
| tetrahydrofuran | 400 parts |
| cyclohexanone | 200 parts |
| @ Coating liquid 3 of protective layer | |
| polycarbonate of type C | 10 parts |
| charge-transferring material having a structural formula below | 7 parts |

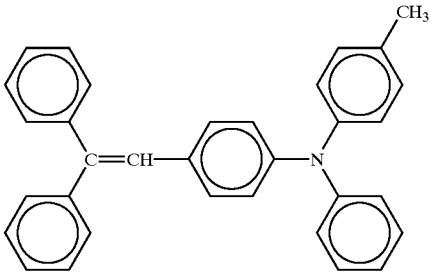

| | |
|---|---|
| alumina particles (specific resistance: $2.5 \times 10^{12}$ Ω · cm, mean primary grain size: 0.5 μm) | 5 parts |
| tetrahydrofuran | 400 parts |
| cyclohexanone | 200 parts |

The coating liquids of the protective layer are used in a way described below. The coating liquid liquids 1, 2 and 3 are sequentially applied onto the substrate by using three spray heads. Here the word "sequentially" means that a layer (from coating liquid 2 or 3) is formed on a previous layer (from coating liquid 1 or 2) by using a spray method after the previous layer is completely tack free. Moreover, the substrate is coated with corresponding amounts of the coating liquids 1, 2 and 3 to sequentially form three layers having thickness of 2 μm, 2 μm and 1 μm, respectively. Thereby a protective layer is obtained with a total thickness of 5 μm.

EXAMPLE 16

The photoreceptor in this example is fabricated by using the same method as in Example 15, except that the compositions of the three coating liquids 1, 2 and 3 of the protective layer are changed as follows.

@ Coating liquid 1 of protective layer

| | |
|---|---|
| polymeric charge-transferring material having a structural formula below | 7 parts |

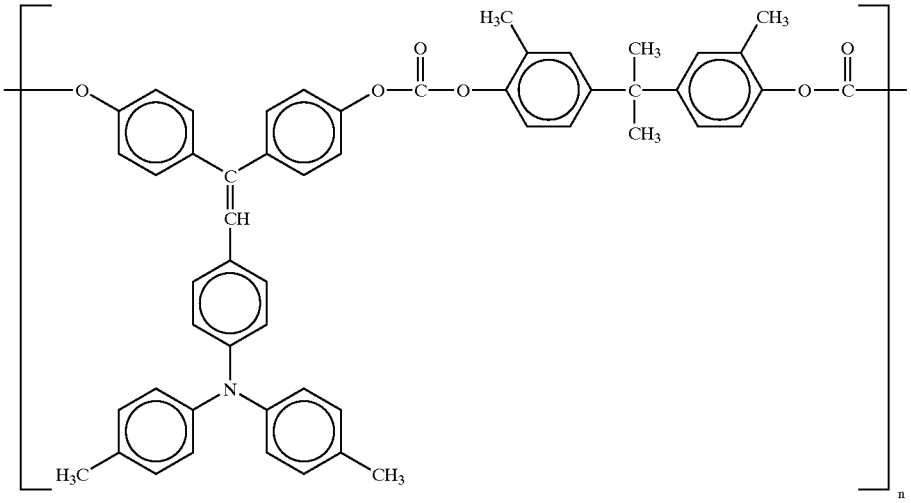

| | |
|---|---|
| alumina particles (specific resistance: $2.5 \times 10^{12}$ Ω · cm, mean primary grain size: 0.2 μm) | 2 parts |
| tetrahydrofuran | 400 parts |
| cyclohexanone | 200 parts |

@ Coating liquid 2 of protective layer

| | |
|---|---|
| polymeric charge-transferring material having a structural formula below | 7 parts |

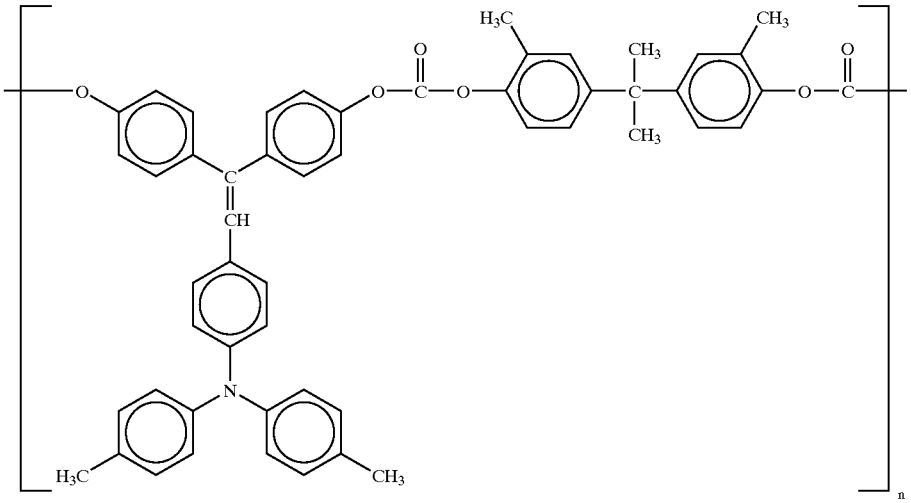

| | |
|---|---|
| alumina particles (specific resistance: $2.5 \times 10^{12}$ Ω · cm, mean primary grain size: 0.2 μm) | 1 part |
| alumina particles (specific resistance: $2.5 \times 10^{12}$ Ω · cm, mean primary grain size: 0.5 μm) | 1 part |
| tetrahydrofuran | 400 parts |
| cyclohexanone | 200 parts |

@ Coating liquid 3 of protective layer

| | |
|---|---|
| polymeric charge-transferring material having a structural formula below | 7 parts |

-continued

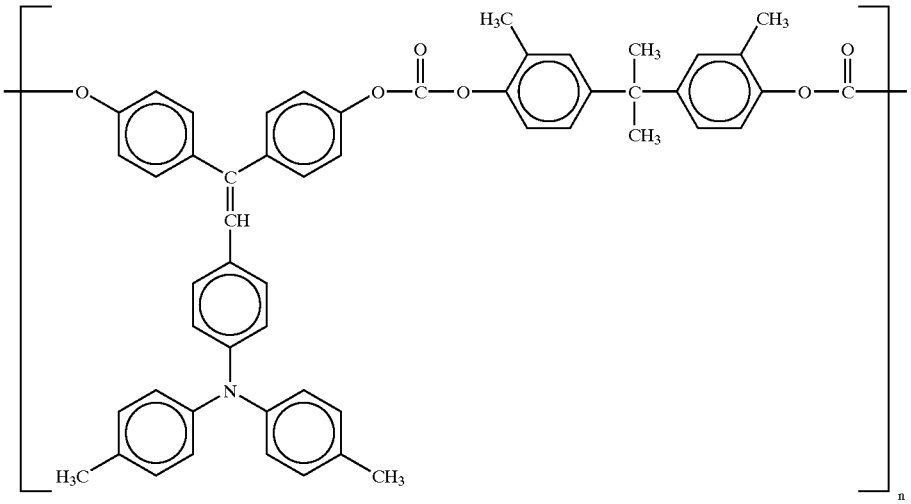

| | |
|---|---|
| alumina particles (specific resistance: $2.5 \times 10^{12}$ Ω · cm, mean primary grain size: 0.5 μm) | 2 parts |
| tetrahydrofuran | 400 parts |
| cyclohexanone | 200 parts |

Comparative Example 18

The photoreceptor in this example is fabricated by using the same method as in Example 15, except that only the coating liquid 1 is used to form a protective layer with a thickness of 5 μm.

Comparative Example 19

The photoreceptor in this example is fabricated by using the same method as in Example 15, except that only the coating liquid 2 is used to form a protective layer with a thickness of 5 μm.

Comparative Example 20

The photoreceptor in this example is fabricated by using the same method as in Example 15, except that only the coating liquid 3 is used to form a protective layer with a thickness of 5 μm.

Comparative Example 21

The photoreceptor in this example is fabricated by using same method as in Example 16, except that only the coating liquid 1 is used to form a protective layer with a thickness of 5 μm.

Comparative Example 22

The photoreceptor in this example is fabricated by using the same method as in Example 16, except that only the coating liquid 2 is used to form a protective layer with a thickness of 5 μm.

Comparative Example 23

The photoreceptor in this example is fabricated by using the same method as in Example 16, except that only the coating liquid 3 is used to form a protective layer with a thickness of 5 μm.

Testing Example 4

The photosensitive bodies of Example 15~16 and Comparative Example 18~23 each is used in the electrophotographic process illustrated by FIG. 5. However, the pre-cleaning exposure is not performed and the charging member is a scorotron charger here. A semiconductor laser of 655 nm is used as a light source for the image exposure and a polygon mirror is also used to write the image. The photoreceptor is used to print 20,000 sheets continuously, and is evaluated at the initial time and after the printing of 20,000 sheets. Moreover, the wearing amount of the photoreceptor after the printing of 20,000 sheets is also examined. The testing results are shown in Table 6.

TABLE 6

| | Image Quality (initially) | Image Quality (after 20,000 sheets) | Wearing Amount (μm) |
|---|---|---|---|
| Example 15 | good | good | 1.0 |
| Example 16 | good | good | 0.8 |
| Comparative Example 18 | good | a few black stripes | 1.9 |
| Comparative Example 19 | good | resolution down | 1.2 |
| Comparative Example 20 | good | resolution down | 1.0 |
| Comparative Example 21 | good | a few black stripes | 1.7 |
| Comparative Example 22 | good | resolution down | 1.1 |
| Comparative Example 23 | good | resolution down | 0.9 |

EXAMPLE 17

In this example, the electrophotographic process illustrated by FIG. 5 is used as in Example 15, except that the charging member is changed from the scorotron charger to a charging roller, which is disposed contacting with the photoreceptor. The photoreceptor of Example 1 is mounted in the apparatus, and the same evaluation are performed as in Example 15 with the follow charging condition.

Charging condition: DC bias: −900V

The image quality is good after the printing of 20,000 sheets as well as at the initial time. The image has only extremely few abnormalities (swear of the background) recognized after the printing of 20,000 sheets because of the contamination of the charging roller (toner filming). However, the stink of ozone is much weaker during the continuous printing as compared with Example 15.

EXAMPLE 18

In this example, the evaluation is conducted under the same conditions as in Example 17, except that an insulating tape is pasted on two ends of the charging roller used in Example 17. The insulating tape has a thickness of 50 μm and a width of 5 mm to create a spatial gap (50 μm) between the surfaces of the photoreceptor and the charging roller, as shown in FIG. 9. The results shows that the contamination of the charging roller recognized in Example 17 is not found completely, and the image quality is good after the printing of 20,000 sheets as we as at the initial time. However, during an output of a halftone image after the printing of 20,000 sheets, extremely little image unevenness is recognized because of the charge unevenness.

EXAMPLE 19

In this example, the evaluation is conducted under the same conditions as in Example 18, except that the charging conditions are changed as follows.

Charging condition:

DC bias: −900V

AC bias: 1.8 kV (peak to peak), frequency: 1.7 kHz

In this example, the image quality is good after the printing of 20,000 sheets as we as at the initial time. Moreover, the contamination of the charging roller recognized in Example 17 and the halftone image unevenness recognized in Example 18 both are not found.

EXAMPLE 20

An aluminum cylinder is coated sequentially with a coating liquid of an undercoating layer, a coating liquid of a charge-generating layer and a coating liquid of a charge-transferring layer having the compositions described below, wherein a drying step is performed after each coating step. A protective layer is then formed on the charge-transferring layer by using the coating and drying method. Thereby an electrophotographic photoreceptor is formed with a undercoating layer of 3 μm, a charge-generating layer of 0.3 μm, a charge-transferring layer of 22 μm and a protective layer of 3 μm. Moreover, the undercoating layer, the charge-generating layer and the charge-transferring layer are formed by using the immersing coating method and the protective layer is formed by using the spray method.

| | |
|---|---|
| @ Coating liquid of undercoating layer | |
| titanium dioxide powder | 100 parts |
| alcohol-soluble nylon | 100 parts |
| methanol | 500 parts |
| butanol | 300 parts |
| @ Coating liquid of charge-generating layer | |
| bisazo pigment having a structural formula below | 10 parts |

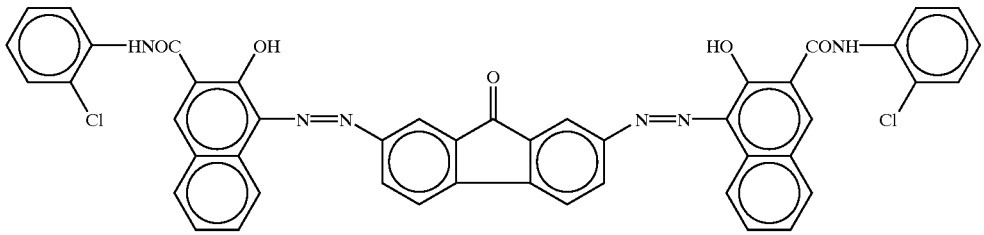

| | |
|---|---|
| polyvinylbutyral | 2 parts |
| 2-butanone | 200 parts |
| cyclohexanone | 400 parts |
| @ Coating liquid of charge-transferring layer | |
| polycarbonate of type Z | 10 parts |
| charge-transferring material having a structural formula below | 7 parts |

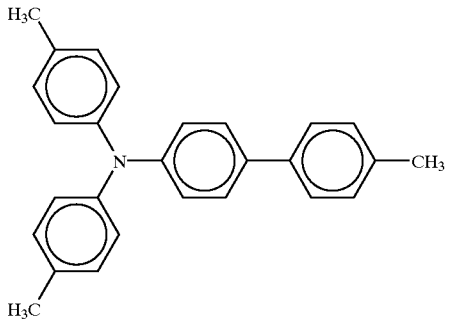

tetrahydrofuran

-continued

| | |
|---|---|
| | 200 parts |

@ Coating liquid 1 of protective layer

| | |
|---|---|
| polycarbonate of type Z | 10 parts |
| charge-transferring material having a structural formula below | 6 parts |

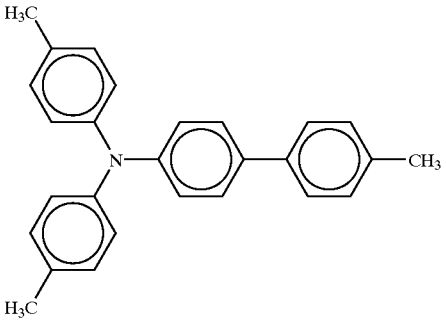

| | |
|---|---|
| titanium oxide particles (specific resistance: $2.5 \times 10^{12}$ Ω · cm, mean primary grain size: 0.1 μm) | 5 parts |
| toluene | 600 parts |

@ Coating liquid 2 of protective layer

| | |
|---|---|
| polycarbonate of type Z | 10 parts |
| charge-transferring material having a structural formula below | 6 parts |

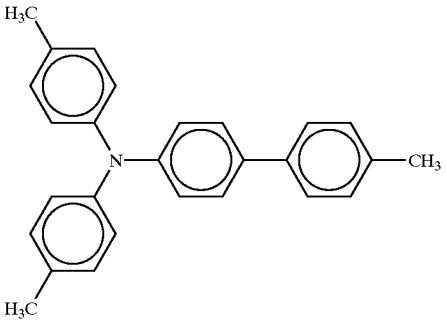

| | |
|---|---|
| titanium oxide particles (specific resistance: $2.5 \times 10^{12}$ Ω · cm, mean primary grain size: 0.1 μm) | 3 parts |
| titanium oxide particles (specific resistance: $2.5 \times 10^{12}$ Ω · cm, mean primary grain size: 0.5 μm) | 2 parts |
| toluene | 600 parts |

@ Coating liquid 3 of protective layer

| | |
|---|---|
| polycarbonate of type Z | 10 parts |
| charge-transferring material having a structural formula below | 6 parts |

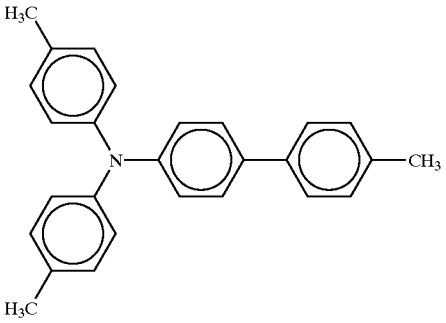

| | |
|---|---|
| titanium oxide particles (specific resistance: $2.5 \times 10^{12}$ Ω · cm, mean primary grain size: 0.5 μm) | 5 parts |
| toluene | 600 parts |

The coating liquids of the protective layer are used in a way described below. The coating liquid liquids 1, 2 and 3 are sequentially applied onto the substrate by using three spray heads. Here the word "sequentially" means that a layer (from coating liquid 2 or 3) is formed on a previous layer (from coating liquid 1 or 2) by using a spray method after the previous layer is completely tack free. Moreover, the substrate is coated with corresponding amounts of the coating liquids 1, 2 and 3 to sequentially form three layers each having a thickness of 1 $\mu$m. Thereby a protective layer is obtained with a total thickness of 3 $\mu$m.

EXAMPLE 21

The photoreceptor in this example is fabricated by using the same method as in Example 20, except that the compositions of the three coating liquids 1, 2 and 3 of the protective layer are changed as follows.

@ Coating liquid 1 of protective layer polymeric charge-transferring material having a structural formula below 7 parts

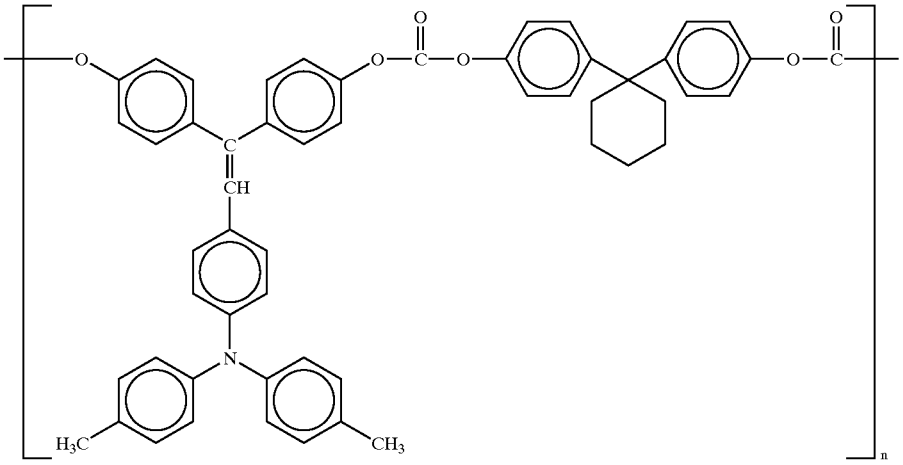

alumina particles (specific resistance: $2.5 \times 10^{12}$ $\Omega \cdot$ cm, mean primary grain size: 0.3 $\mu$m) 3 parts
tetrahydrofuran 400 parts
cyclohexanone 200 parts @ Coating liquid 2 of protective layer polymeric charge-transferring material having a structural formula below 7 parts

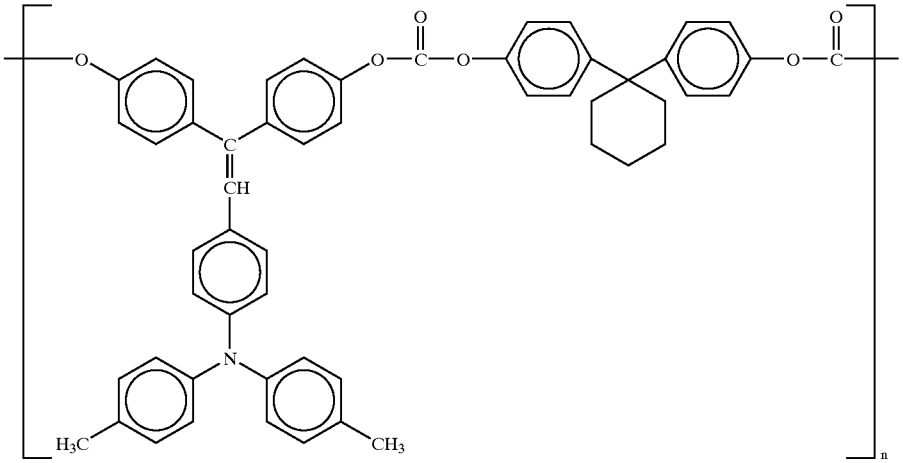

silica particles (specific resistance: $4 \times 10^{13}$ $\Omega \cdot$ cm, mean primary grain size: 0.5 $\mu$m) 1 part
silica particles (specific resistance: $2.5 \times 10^{12}$ $\Omega \cdot$ cm, mean primary grain size: 0.3 $\mu$m) 2 part
tetrahydrofuran 400 parts
cyclohexanone 200 parts @ Coating liquid 3 of protective layer polymeric charge-transferring material having a structural formula below 7 parts -continued

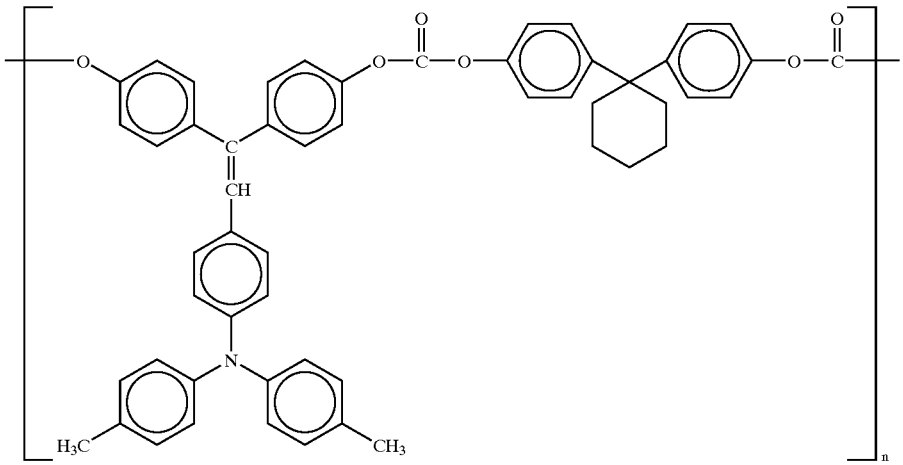

| | |
|---|---|
| silica particles (specific resistance: $4 \times 10^{13}$ Ω · cm, mean primary grain size: 0.5 μm) | 3 part |
| tetrahydrofuran | 400 parts |
| cyclohexanone | 200 parts |

Comparative Example 24

The photoreceptor in this example is fabricated by using the same method as in Example 20, except that only the coating liquid 1 is used to form a protective layer with a thickness of 3 μm.

Comparative Example 25

The photoreceptor in this example is fabricated by using the same method as in Example 20, except that only the coating liquid 2 is used to form a protective layer with a thickness of 3 μm.

Comparative Example 26

The photoreceptor in this example is fabricated by using the same method as in Example 20, except that only the coating liquid 3 is used to form a protective layer with a thickness of 3 μm.

Comparative Example 27

The photoreceptor in this example is fabricated by using the same method as in Example 20, except that the protective layer is not formed and the thickness of the charge-transferring layer is changed to 25 μm.

Comparative Example 28

The photoreceptor in this example is fabricated by using the same method as in Example 21, except that only the coating liquid 1 is used to form a protective layer with a thickness of 3 μm.

Comparative Example 29

The photoreceptor in this example is fabricated by using the same method as in Example 21, except that only the coating liquid 2 is used to form a protective layer with a thickness of 3 μm.

Comparative Example 30

The photoreceptor in this example is fabricated by using the same method as in Example 21, except that only the coating liquid 3 is used to form a protective layer with a thickness of 3 μm.

Testing Example 5

The photosensitive bodies of Example 20~21 and Comparative Example 24~30 each is used in the electrophotographic process illustrated by FIG. 6 for testing. However, the pre-cleaning exposure is not performed. An LED of 655 nm is used as a light source for the image exposure. The photoreceptor is used to print 30,000 sheets continuously, and is evaluated at the initial time and after the printing of 30,000 sheets. Moreover, the wearing amount of the photoreceptor after the printing of 30,000 sheets is also examined. The testing results are shown in Table 7.

TABLE 7

| | Image Quality (initially) | Image Quality (after 30,000 sheets) | Wearing Amount (μm) |
|---|---|---|---|
| Example 20 | good | good | 1.2 |
| Example 21 | good | good | 1.0 |
| Comparative Example 24 | good | a few black stripes | 2.3 |
| Comparative Example 25 | good | resolution down | 1.3 |
| Comparative Example 26 | good | resolution down | 1.2 |
| Comparative Example 27 | good | swear of the background | 4.2 |
| Comparative Example 28 | good | a few black stripes | 1.8 |
| Comparative Example 29 | good | resolution down | 1.1 |
| Comparative Example 30 | good | resolution down | 1.0 |

EXAMPLE 22

The filler used in Example 20 is subjected to a surface treatment that uses a titanate-type coupling agent with a treating amount of 20%. The filler is then used to formulate the coating liquids 1, 2 and 3 of the protective layer as in Example 20. Thereafter, the averaged size of the grains in the coating liquid is measured by using CAPA700 (manufactured by HORIBA Ltd.) and the precipitability of grains in the coating liquid is evaluated, wherein the coating liquid is placed still in a testing tube and the degree of the precipitation of the grains therein is confirmed with naked eyes. The testing results are shown in Table 8, wherein each test is done to the coating liquid 3 of the protective layer.

EXAMPLE 23

The filler used in Example 20 is subjected to a surface treatment using $Al_2O_3$ with a treating amount of 20%. The filler is then used to formulate the coating liquids 1, 2 and 3 of the protective layer as in Example 20. Thereafter, the averaged size of the grains in the coating liquid is measured by using CAPA700 (manufactured by HORIBA Ltd.) and the precipitability of grains in the coating liquid is evaluated, wherein the coating liquid is placed still in a testing tube and the degree of the precipitation of the grains therein is confirmed with naked eyes. The testing results are also shown in Table 8, wherein each test is done to the coating liquid 3 of the protective layer.

TABLE 8

| Used dispersing Liquid | Average grain size ($\mu$m) | Precipitation test |
|---|---|---|
| Example 20 | 0.83 | Grain precipitation observed after 2 days |
| Example 22 | 0.64 | Grain precipitation observed after 5 days |
| Example 23 | 0.67 | Grain precipitation observed after 5 days |

EXAMPLE 24

In this example, the dispersing liquid of Example 22 is used to fabricate a photoreceptor by using the same method as in Example 20. However, the samples for evaluating the transmittance of the protective layer are prepared by forming only the protective layer on a polyester film. The resulting outlook and the surface roughness $R_z$ of the photoreceptor and the transmittance of the protective layer at 665 nm are shown in Table 9.

EXAMPLE 25

In this example, the dispersing liquid of Example 23 is used to fabricate a photoreceptor by using the same method as in Example 20. However, the samples for evaluating the transmittance of the protective layer are prepared by forming only the protective layer on a polyester film. The resulting outlook and the surface roughness $R_z$ of the photoreceptor and the transmittance of the protective layer at 665 nm are also shown in Table 9.

TABLE 9

| Used dispersing liquid | Outlook | $R_z$ ($\mu$m) | Transmittance (%) |
|---|---|---|---|
| Example 20 | slightly dull | 0.93 | 87 |
| Example 22 | glossy | 0.62 | 93 |
| Example 23 | glossy | 0.66 | 90 |

EXAMPLE 26

The photoreceptor of Example 24 is mounted in the same evaluating apparatus as in Example 20 and then evaluated for the image quality thereof. The results show that the photoreceptor using the dispersing liquid of Example 22 has a higher resolution as compared with the one using the dispersing liquid of Example 20.

EXAMPLE 27

The photoreceptor of Example 25 is mounted in the same evaluating apparatus as in Example 6 and then evaluated for the image quality. The results show that the photoreceptor using the dispersing liquid of Example 23 has a higher resolution as compared with the one using the dispersing liquid obtained in Example 20.

EXAMPLE 28

An aluminum cylinder is coated sequentially with a coating liquid of an undercoating layer, a coating liquid of a charge-generating layer and a coating liquid of a charge-transferring layer having the compositions described below, wherein a drying step is performed after each coating step. A protective layer is then formed on the charge-transferring layer by using the coating and drying method. Thereby an electrophotographic photoreceptor is formed with an undercoating layer of 3.5 $\mu$m, a charge-generating layer of 0.2 $\mu$m, a charge-transferring layer of 21 $\mu$m and a protective layer of 4 $\mu$m.

| | |
|---|---|
| @ Coating liquid of undercoating layer | |
| titanium dioxide powder | 400 parts |
| melamine resin | 65 parts |
| alkyd resin | 120 parts |
| 2-butanone | 400 parts |
| @ Coating liquid of charge-generating layer | |
| titanylphthalocyanone having a XD spectrum as shown in FIG. 8 (the titanylphthalocyanine disclosed in Japanese Patent Application No. 2001-19871) | 8 parts |
| polyvinylbutyral | 5 parts |
| 2-butanone | 200 parts |

-continued

@ Coating liquid of charge-transferring layer

| | |
|---|---|
| polycarbonate of type Z | 10 parts |
| charge-transferring material having a structural formula below | 7 parts |

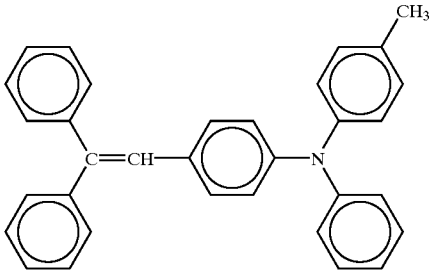

| | |
|---|---|
| dichloromethane | 80 parts |

@ Coating liquid 1 of protective layer

| | |
|---|---|
| polyarylate | 10 parts |
| charge-transferring material having a structural formula below | 8 parts |

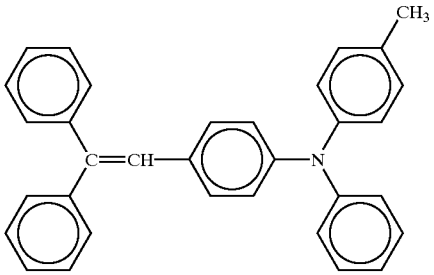

| | |
|---|---|
| alumina particles (specific resistance: $2.5 \times 10^{12}$ Ω · cm, mean primary grain size: 0.2 μm) | 6 parts |
| tetrahydrofuran | 400 parts |
| cyclohexanone | 200 parts |

@ Coating liquid 2 of protective layer

| | |
|---|---|
| polyarylate | 10 parts |
| charge-transferring material having a structural formula below | 8 parts |

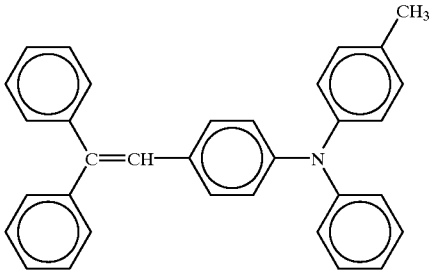

| | |
|---|---|
| alumina particles (specific resistance: $2.5 \times 10^{12}$ Ω · cm, mean primary grain size: 0.2 μm) | 4 parts |
| alumina particles (specific resistance: $2.5 \times 10^{12}$ Ω · cm, mean primary grain size: 0.5 μm) | 2 parts |
| tetrahydrofuran | 400 parts |
| cyclohexanone | 200 parts |

-continued

@ Coating liquid 3 of protective layer

| | |
|---|---|
| polyarylate | 10 parts |
| charge-transferring material having a structural formula below | 8 parts |

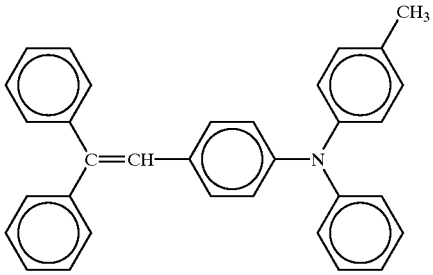

| | |
|---|---|
| alumina particles (specific resistance: $2.5 \times 10^{12}$ Ω · cm, mean primary grain size: 0.5 μm) | 6 parts |
| tetrahydrofuran | 400 parts |
| cyclohexanone | 200 parts |

The coating liquids of the protective layer are used in a way described below. The coating liquid liquids 1, 2 and 3 are sequentially applied onto the substrate by using three spray heads. Here the word "sequentially" means that a layer (from coating liquid 2 or 3) is formed on a previous layer (from coating liquid 1 or 2) by using a spray method after the previous layer is completely tack free. Moreover, the substrate is coated with corresponding amounts of the coating liquids 1, 2 and 3 to sequentially form three layers having thickness of 1.5 μm, 1.5 μm and 1 μm, respectively. Thereby a protective layer is obtained with a total thickness of 4 μm.

Comparative Example 31

The photoreceptor in this example is fabricated by using the same method as in Example 28, except that only the coating liquid 1 is used to form a protective layer with a thickness of 4 μm.

Comparative Example 32

The photoreceptor in this example is fabricated by using the same method as in Example 28, except that only the coating liquid 2 is used to form a protective layer with a thickness of 4 μm.

Comparative Example 33

The photoreceptor in this example is fabricated by using the same method as in Example 28, except that only the coating liquid 3 is used to form a protective layer with a thickness of 4 μm.

Comparative Example 34

The photoreceptor in this example is fabricated by using the same method as in Example 28, except that the protective layer is not formed and the thickness of the charge-transferring layer is changed to 25 μm.

Testing Example 6

The photosensitive bodies of Example 28 and Comparative Example 31~34 each is mounted in a cartridge illustrated by FIG. 7 that is used in an electrophotographic process. A semiconductor laser of 780 nm is used as a light source for the image exposure and a polygon mirror is also used to write the image. The photoreceptor is used to print 20,000 sheets continuously, and is evaluated at the initial time and after the printing of 20,000 sheets. Moreover, the wearing amount of the photoreceptor after the printing of 20,000 sheets is also examined. The testing results are shown in Table 10.

TABLE 10

| | Image Quality (initially) | Image Quality (after 20,000 sheets) | Wearing Amount ($\mu$m) |
|---|---|---|---|
| Example 28 | good | good | 0.9 |
| Comparative Example 31 | good | a few black stripes | 1.8 |
| Comparative Example 32 | good | resolution down | 1.0 |
| Comparative Example 33 | good | resolution down | 0.9 |
| Comparative Example 34 | good | black stripes and swear of the background | 4.2 |

EXAMPLE 29

The photoreceptor in this example is fabricated by using the same method as in Example 7, except that the compositions of the three coating liquids 1, 2 and 3 of the protective layer are changed as follows.

@ Coating liquid 1 of protective layer polymeric charge-transferring material having a structural formula below 7 parts

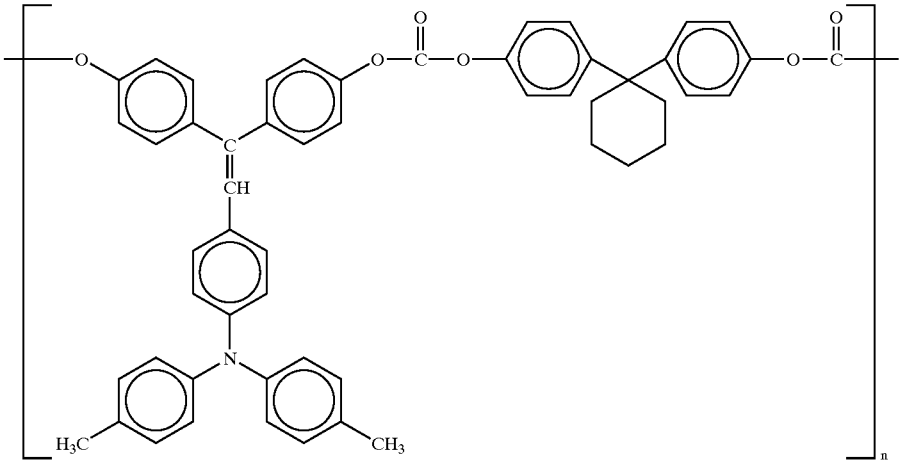

silica particles (specific resistance: $4 \times 10^{13}$ $\Omega \cdot$ cm, mean primary grain size: 0.3 $\mu$m) 3 parts tetrahydrofuran 400 parts cyclohexanone 200 parts @ Coating liquid 2 of protective layer polymeric charge-transferring material having a structural formula below 7 parts -continued

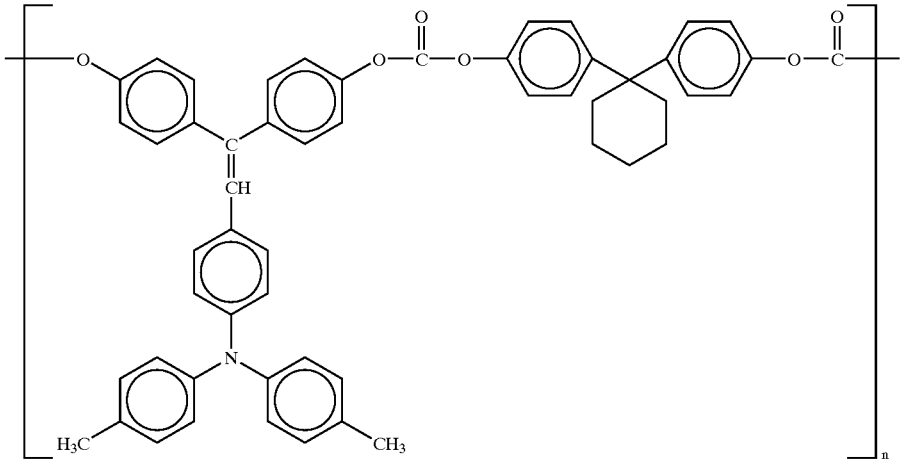

| | |
|---|---|
| silica particles (specific resistance: $4 \times 10^{13}$ Ω · cm, mean primary grain size: 0.5 μm) | 2 part |
| silica particles (specific resistance: $4 \times 10^{13}$ Ω · cm, mean primary grain size: 0.3 μm) | 1 part |
| tetrahydrofuran | 400 parts |
| cyclohexanone | 200 parts |
| @ Coating liquid 3 of protective layer | |
| polymeric charge-transferring material having a structural formula below | 7 parts |

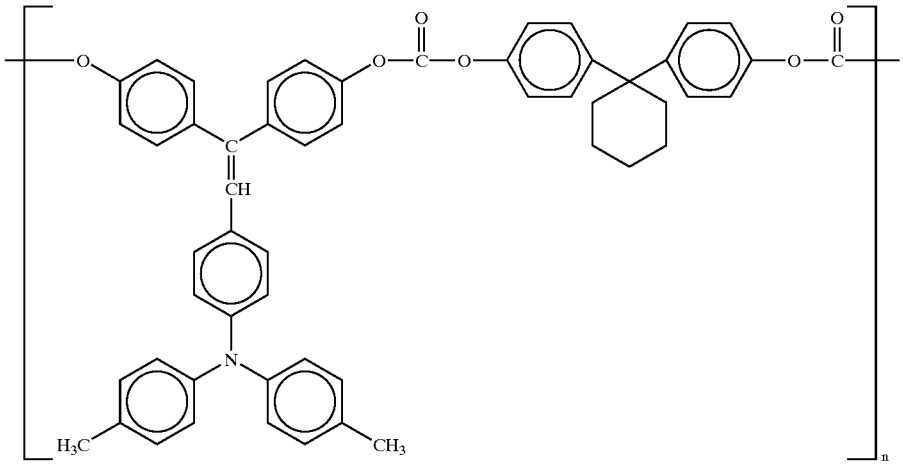

| | |
|---|---|
| silica particles (specific resistance: $4 \times 10^{13}$ Ω · cm, mean primary grain size: 0.5 μm) | 3 parts |
| tetrahydrofuran | 400 parts |
| cyclohexanone | 200 parts |

Testing Example 7

The photosensitive bodies of Example 7 and Example 29 each is used in the electrophotographic process illustrated by FIG. 6. However, the pre-cleaning exposure is not performed. An LED of 655 nm is used as a light source for the image exposure. The photoreceptor is used to print 30,000 sheets continuously, and is evaluated for the surface voltages of the exposed region and the unexposed part at the initial time and after the printing of 30,000 sheets. The testing results are shown in Table 11.

TABLE 11

| | Initially | | After 30,000 sheets | |
|---|---|---|---|---|
| | Voltage of unexposed region (−V) | Voltage of exposed region (−V) | Voltage of unexposed region (−V) | Voltage of exposed region (−V) |
| Example 7 | 800 | 90 | 810 | 95 |
| Example 29 | 805 | 100 | 810 | 115 |

EXAMPLE 30

The photoreceptor in this example is fabricated by using the same method as in Example 21, except that the compositions of the three coating liquids 1, 2 and 3 of the protective layer are changed as follows.

@ Coating liquid 1 of protective layer polymeric charge-transferring material having a structural formula below 7 parts

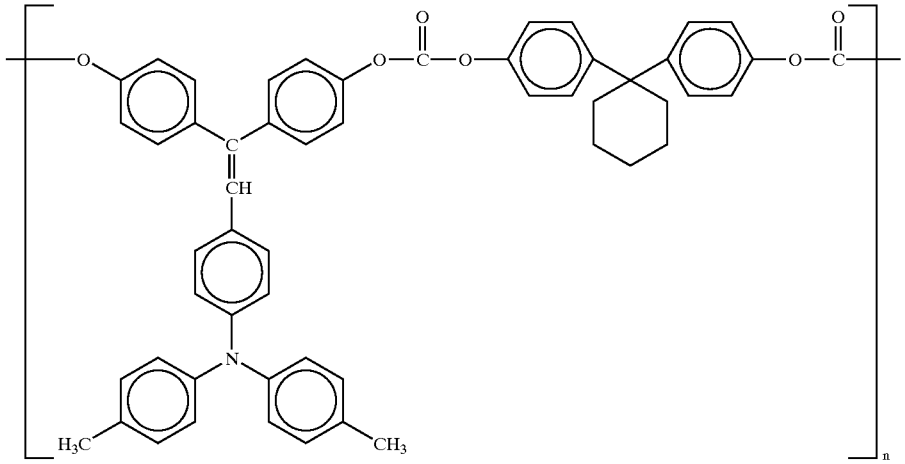

silica particles (specific resistance: $4 \times 10^{13}$ Ω · cm, mean primary grain size: 0.3 μm) 3 parts
tetrahydrofuran 400 parts
cyclohexanone 200 parts @ Coating liquid 2 of protective layer polymeric charge-transferring material having a structural formula below 7 parts

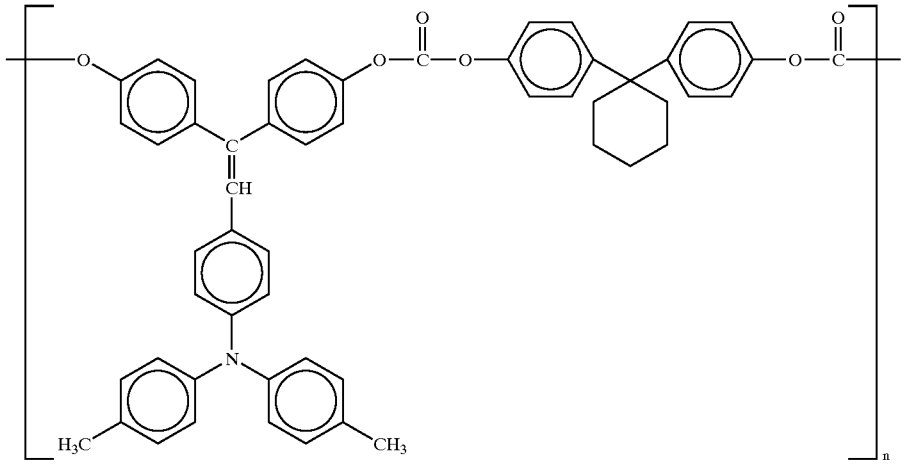

silica particles (specific resistance: $4 \times 10^{13}$ Ω · cm, mean primary grain size: 0.5 μm) 1 part
silica particles (specific resistance: $4 \times 10^{13}$ Ω · cm, mean primary grain size: 0.3 μm) 2 part
tetrahydrofuran 400 parts
cyclohexanone 200 parts @ Coating liquid 3 of protective layer polymeric charge-transferring material having a structural formula below 7 parts -continued

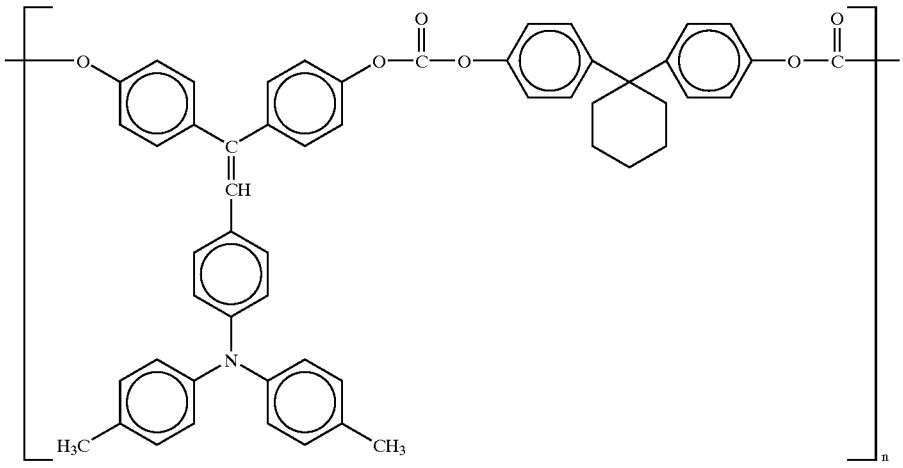

| | |
|---|---|
| silica particles (specific resistance: $4 \times 10^{13}$ Ω · cm, mean primary grain size: 0.5 μm) | 3 parts |
| tetrahydrofuran | 400 parts |
| cyclohexanone | 200 parts |

Testing Example 8

The photosensitive bodies of Examples 21 and 30 each is used in the electrophotographic process illustrated by FIG. 6. However, the pre-cleaning exposure is not performed. An LED of 655 nm is used as a light source for the image exposure. The photoreceptor is used to print 30,000 sheets continuously, and is evaluated for the surface voltages of the exposed region and the unexposed region at the initial time and after the printing of 30,000 sheets. The testing results are shown in Table 12.

TABLE 12

| | Initially | | After 30,000 sheets | |
|---|---|---|---|---|
| | Voltage of unexposed region (−V) | Voltage of exposed region (−V) | Voltage of unexposed region (−V) | Voltage of exposed region (−V) |
| Example 21 | 820 | 100 | 825 | 110 |
| Example 30 | 825 | 110 | 830 | 125 |

EXAMPLE 31

The conductive support (JIS1050) of Example 28 is subjected to an anodizing coating treatment with the procedures described below. Thereafter, an undercoating layer, the same charge-generating layer as in Example 28, a charge-transferring layer and a protective layer are sequentially formed on the conductive support to form a photoreceptor.

@ Anodizing Coating Treatment

The surface of the conductive support is mirror finished, cleaned for degreasing, and then cleaned with water. Subsequently, the conductive support is immersed in an electrolytic bath containing sulfuric acid of 15 vol % under 20° C. to have an anodizing coating treatment with an electrolytic voltage of 15V for 30 minutes. The conductive support is cleaned with water and then subjected to a sealing treatment with a 7% aqueous solution of nickel acetate under 50° C. Thereafter, the conductive support is cleaned by using pure water and the conductive support having a anodizing film of 6 μm thereon is completed.

Testing Example 9

The photosensitive bodies fabricated by using the methods described in Example 28 and 31 each is mounted in a cartridge illustrated by FIG. 7 that is used in an electrophotographic process. A semiconductor laser of 780 nm is used as a light source for the image exposure and a polygon mirror is also used to write the image. The photoreceptor is used to print 20,000 sheets continuously, and is evaluated at the initial time and after the printing of 20,000 sheets. As seen form the results of comparing the image qualities of the two after the printing of 20,000 sheets, the two photosensitive bodies both have no problem in real use. However, as compared with the images of Example 31, the images of Example 28 have more stains (black spots) on its surface part.

EXAMPLE 32

The photoreceptor of Example 1 is mounted in the electrophotographic apparatus illustrated by FIG. 10. The evaluation is conducted by using totally 4 image forming elements to form full-color images of 20,000 sheets under the conditions described below, and the results are shown in Table 13.

Charging conditions:

DC bias: −800V

AC bias: 2.0 kV (peak to peak), frequency: 2 kHz

Exposing condition:

Semiconductor laser of 655 nm (polygon mirror is also used to write the image)

Comparative Example 35

In this example, the same image evaluating test as in Example 32 is performed, except that the photoreceptor of Example 32 is changed to that of Comparative Example 1. The results are shown in Table 13.

Comparative Example 36

In this example, the same image evaluating test as in Example 32 is performed except that the photoreceptor of Example 32 is changed to that of Comparative Example 3. The results are also shown in Table 13.

TABLE 13

| | Image Quality (initially) | Image Quality (after 20,000 sheets) |
|---|---|---|
| Example 32 | Good | good |
| Comparative Example 35 | Good | Color reproducibility down |
| Comparative Example 36 | Good | resolution down |

As seen from the testing results, the photoreceptor provided in this invention can be repeatedly used to form high-quality images stably with high durability. Moreover, the electrophotographic method, the electrophotographic apparatus and the cartridge for electrophotography of this invention can be used to form high-quality images even after repeated use.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. An electrophotographic photoreceptor, comprising:

a photosensitive layer containing an organic charge-generating material and an organic charge-transferring material; and a protective layer containing at least two kinds of filler having different volume-averaged grain sizes, wherein a grain size distribution of the filler continuously increases from the photosensitive layer side toward a surface side.

2. The electrophotographic photoreceptor of claim 1, wherein the fillers having different volume-averaged grain sizes comprises the same material.

3. The electrophotographic photoreceptor of claim 1, wherein the photosensitive layer comprises a charge-generating layer containing the organic charge-generating material and a charge-transferring layer containing the organic charge-transferring material.

4. The electrophotographic photoreceptor of claim 1, wherein the organic charge-generating material is an azo pigment or a phthalocyanine pigment.

5. The electrophotographic photoreceptor of claim 1, wherein the filler in the protective layer comprises an inorganic pigment or a metal oxide having a specific resistance higher than $10^{10}\Omega\cdot$cm.

6. The electrophotographic photoreceptor of claim 5, wherein the metal oxide is selected from the group consisting of silica, alumina and titanium oxide having a specific resistance higher than $10^{10}\Omega\cdot$cm.

7. The electrophotographic photoreceptor of claim 5, wherein a pH of the metal oxide is higher than 5.

8. The electrophotographic photoreceptor of claim 5, wherein a dielectric constant of the metal oxide is larger than 5.

9. The electrophotographic photoreceptor of claim 5, wherein the inorganic pigment or the metal oxide is subjected to a surface treatment with at least one surface-treating agent.

10. The electrophotographic photoreceptor of claim 9, wherein the surface treating agent used for the surface treatment of the inorganic pigment filler or the metal oxide filler is one selected from the group consisting of titanate-type coupling agents, aluminum-type coupling agents, higher fatty acid-type coupling agent, $Al_2O_3$, $TiO_2$ and $ZrO_2$, a mixture of some compounds mentioned above, or a mixture of some compound(s) mentioned above and a silane coupling agent.

11. The electrophotographic photoreceptor of claim 9, wherein the inorganic pigment or the metal oxide is subjected to the surface treatment by an amount from 3 wt % to 30 wt %.

12. The electrophotographic photoreceptor of claim 1, wherein the filler having a larger volume-averaged grain size has a mean primary grain size from 0.3 $\mu$m to 1.0 $\mu$m.

13. The electrophotographic photoreceptor of claim 1, wherein in a region near an outmost surface of the protective layer, the filler having a larger volume-averaged grain size takes a percentage larger than 70%.

14. The electrophotographic photoreceptor of claim 1, wherein the filler having a smaller volume-averaged grain size has a specific resistance lower than that of the filler having a larger volume-averaged grain size.

15. The electrophotographic photoreceptor of claim 1, wherein the protective layer further comprises a charge-transferring material.

16. The electrophotographic photoreceptor of claim 15, wherein the charge-transferring material comprises a polymeric charge-transferring material.

17. The electrophotographic photoreceptor of claim 15, wherein the polymeric charge-transferring material comprises a polycarbonate material having at least a triarylamine group on a main chain and/or a side chain thereof.

18. The electrophotographic photoreceptor of claim 1, wherein the protective layer contains a binder resin that contains at least one of a polycarbonate resin and a polyarylate resin.

19. The electrophotographic photoreceptor of claim 1, further comprising an electrically conductive support that has a surface treated with anodizing coating.

20. A method for fabricating the electrophotographic photoreceptor of claim 1, wherein the protective layer is formed by using a method comprising:

preparing at least two coating liquids that contain fillers of different grain size distributions; and sequentially coating the photosensitive layer with the coating liquids in the order of increasing grain size distribution via spraying, wherein a layer is formed on a previous layer before the previous layer is tack free.

21. A method for fabricating the electrophotographic photoreceptor of claim 1, wherein the protective layer is formed by using a method comprising:

preparing at least two dispersing liquids that contain fillers of different grain size distributions; and simultaneously using at least two spray heads to coat the photosensitive layer with the coating liquids, wherein a ratio of discharge amounts of the coating liquids are continuously changed with time to form the protective layer having a gradient grain size distribution.

22. An electrophotographic method, comprising performing at least charging, image exposure, image development and image transfer repeatedly by using the electrophotographic photoreceptor of claim 1.

23. An electrophotographic apparatus, comprising a charging device, an image exposing device, a developing device, a transferring device and the electrophotographic photoreceptor of claim 1.

24. An electrophotographic apparatus, comprising a charging device, an image exposing device, a developing device, a transferring device and the electrophotographic photoreceptor of claim 1, wherein the image exposing device uses a laser diode (LD) or a light emitting diode (LED) to write an electrostatic latent image on the photoreceptor in a digital manner.

25. An electrophotographic apparatus, comprising a charging device, an image exposing device, a developing device, a transferring device and the electrophotographic photoreceptor of claim 1, wherein the charging device comprising a charging member in contact with or proximal to the photoreceptor.

26. The electrophotographic apparatus of 25, wherein a distance between the charging member and the photoreceptor is smaller than 200 $\mu$m.

27. The electrophotographic apparatus of 25, wherein the charging member superimposes an alternating current (AC) onto a direct current (DC) component for charging the photoreceptor.

28. A full-color electrophotographic apparatus, comprising a plurality of image forming elements each comprising a charging device, an image exposing device, a developing device, a transferring device, and the electrophotographic photoreceptor of claim 1.

29. A process cartridge used in an electrophotographic apparatus, comprising the electrophotographic photoreceptor of claim 1.

30. An electrophotographic photoreceptor, comprising:

a photosensitive layer containing an organic charge-generating material and an organic charge-transferring material; and a protective layer comprising at least two sub-layers that contain fillers of different volume-averaged grain sizes, wherein the grain size distribution of the filler gradually increases from the photosensitive layer side toward a surface side.

31. The electrophotographic photoreceptor of claim 30, wherein the fillers having different volume-averaged grain sizes comprises the same material.

32. The electrophotographic photoreceptor of claim 30, wherein the photosensitive layer comprises a charge-generating layer containing the organic charge-generating material and a charge-transferring layer containing the organic charge-transferring material.

33. The electrophotographic photoreceptor of claim 30, wherein the organic charge-generating material is an azo pigment or a phthalocyanine pigment.

34. The electrophotographic photoreceptor of claim 30, wherein the filler in the protective layer comprises an inorganic pigment or a metal oxide having a specific resistance higher than $10^{10}\Omega\cdot$cm.

35. The electrophotographic photoreceptor of claim 34, wherein the metal oxide is selected from the group consisting of silica, alumina and titanium oxide having a specific resistance higher than $10^{10}\Omega\cdot$cm.

36. The electrophotographic photoreceptor of claim 34, wherein a pH of the metal oxide is higher than 5.

37. The electrophotographic photoreceptor of claim 34, wherein a dielectric constant of the metal oxide is larger than 5.

38. The electrophotographic photoreceptor of claim 34, wherein the inorganic pigment or the metal oxide is subjected to a surface treatment with at least one surface-treating agent.

39. The electrophotographic photoreceptor of claim 38, wherein the surface-treating agent used for the surface treatment of the inorganic pigment filler or the metal oxide filler is one selected from the group consisting of titanate-type coupling agents, aluminum-type coupling agents, higher fatty acid-type coupling agent, $Al_2O_3$, $TiO_2$ and $ZrO_2$, a mixture of some compounds mentioned above, or a mixture of some compound(s) mentioned above and a silane coupling agent.

40. The electrophotographic photoreceptor of claim 38, wherein the inorganic pigment or the metal oxide is subjected to the surface treatment by an amount from 3 wt % to 30 wt %.

41. The electrophotographic photoreceptor of claim 30, wherein the filler having a larger volume-averaged grain size has a mean primary grain size from 0.3 $\mu$m to 1.0 $\mu$m.

42. The electrophotographic photoreceptor of claim 30, wherein in a region near an outmost surface of the protective layer, the filler having a larger volume-averaged grain size takes a percentage larger than 70%.

43. The electrophotographic photoreceptor of claim 30, wherein the filler having a smaller volume-averaged grain size has a specific resistance lower than that of the filler having a larger volume-averaged grain size.

44. The electrophotographic photoreceptor of claim 30, wherein the protective layer further comprises a charge-transferring material.

45. The electrophotographic photoreceptor of claim 44, wherein the charge-transferring material comprises a polymeric charge-transferring material.

46. The electrophotographic photoreceptor of claim 44, wherein the polymeric charge-transferring material comprises a polycarbonate material having at least a triarylamine group on a main chain and/or a side chain thereof.

47. The electrophotographic photoreceptor of claim 30, wherein the protective layer contains a binder resin that contains at least one of a polycarbonate resin and a polyarylate resin.

48. The electrophotographic photoreceptor of claim 30, further comprising an electrically conductive support that has a surface treated with anodizing coating.

49. A method for fabricating the electrophotographic photoreceptor of claim 30, wherein the protective layer is formed by using a method comprising:

preparing at least two coating liquids that contain fillers of different grain size distributions; and sequentially coating the photosensitive layer with the coating liquids in the order of increasing grain size distribution via spraying, wherein a layer is formed on a previous layer after the previous layer is tack free.

* * * * *